US012708190B1

(12) United States Patent
Zou

(10) Patent No.: US 12,708,190 B1
(45) Date of Patent: Aug. 18, 2026

(54) HAIR EXTENSION CARE APPARATUS

(71) Applicant: WELLNA CO., LTD, KL (HK)

(72) Inventor: Junna Zou, Rongcheng City (CN)

(73) Assignee: WELLNA CO., LTD, KL (HK)

( * ) Notice: Subject to any disclaimer, the term of this patent is extended or adjusted under 35 U.S.C. 154(b) by 0 days.

(21) Appl. No.: 19/322,699

(22) Filed: Sep. 9, 2025

(30) Foreign Application Priority Data

Aug. 1, 2025 (CN) ..... 202521635631.0

(51) Int. Cl.
*A45D 44/14* (2006.01)
*A41G 5/00* (2006.01)

(52) U.S. Cl.
CPC ..... *A45D 44/14* (2013.01); *A41G 5/0086* (2013.01)

(58) Field of Classification Search
CPC ..... A45D 24/38; A45D 44/04; A45D 44/14; A41G 5/0086
See application file for complete search history.

(56) References Cited

U.S. PATENT DOCUMENTS 3,473,540 A * 10/1969 Bulow ..... A45D 24/04 D28/29
D282,291 S * 1/1986 Harvey ..... D28/21
5,018,542 A * 5/1991 Lee ..... A45D 24/10 132/901
D490,185 S * 5/2004 Hegner ..... D28/29
7,234,472 B2 * 6/2007 Ramet ..... A45D 24/02 132/270
8,998,002 B1 * 4/2015 Milner ..... A47F 7/00 211/13.1
9,121,113 B2 * 9/2015 Romine ..... D01G 7/12
D768,337 S * 10/2016 Treb ..... A41G 5/0086 D28/73
D828,624 S * 9/2018 Tokko ..... D28/73
D854,862 S * 7/2019 King ..... D6/675
10,433,631 B2 * 10/2019 Ohlgart ..... F16B 2/10
D1,010,936 S * 1/2024 Eslami ..... D28/93
2014/0191634 A1 * 7/2014 Smiley ..... D01G 7/12 248/205.2
2019/0090615 A1 * 3/2019 Ohlgart ..... F16B 47/00
2020/0029640 A1 * 1/2020 Adams ..... A45C 11/00
2022/0402654 A1 * 12/2022 Andrade ..... B65D 25/06

FOREIGN PATENT DOCUMENTS

GB 190921559 A * 2/1910 ..... A45D 44/14
GB 2526043 A * 11/2015 ..... A45D 44/14
GB 2560035 A * 8/2018 ..... D04B 3/00
KR 101872149 B1 * 6/2018 ..... A45D 24/02
KR 20180092705 A * 8/2018 ..... A45D 24/007

OTHER PUBLICATIONS

Translation KR 20180092705.*
Translation KR 101872149.*

* cited by examiner

*Primary Examiner* — Shaun R Hurley
(74) *Attorney, Agent, or Firm* — Che-Yang Chen

(57) ABSTRACT

The present invention relates to a hair extension care apparatus, where the hair extension care apparatus includes an installation frame, a sparse-tooth component, and a dense-tooth component, and both the sparse-tooth component and the dense-tooth component are installed on the installation frame to fix a hair extension, which resolves a problem of a limited application scope of a conventional hair extension care apparatus and can meet care needs of different hair extensions and facilitate compatibility with multiple types of hair extensions.

15 Claims, 17 Drawing Sheets

HAIR EXTENSION CARE APPARATUS

TECHNICAL FIELD

This utility model relates to the field of hair extension care technology, and in particular, to a hair extension care apparatus.

BACKGROUND

Hair extension care apparatuses are mainly used for hanging hair extensions to facilitate care operations such as storage, cleansing, combing, drying, dyeing, and curling. The hair extension care apparatuses can enhance convenience and efficiency of hair extension care through proper structural design. However, in the prior art, adaptability and functionality disadvantages of the hair extension care apparatuses urgently need to be addressed.

In the prior art, conventional hair extension care apparatuses usually use comb tooth structures with relatively great tooth spacing. Although this type of design is suitable for hanging and combing some hair extensions or hair wefts with relatively great transverse lengths, an application scope of such design is obviously limited. For example, hair extensions or hair wefts with relatively small transverse lengths, such as tape-in hairpieces and hair bundles, cannot be effectively fixed or supported by comb teeth of conventional care apparatuses with wide tooth spacing, and as a result, the hair extensions or hair wefts are easy to slip off or deform in care processes. In addition, the structures with monotonous tooth spacing cannot meet care needs of different types of hair extensions. Users need to prepare various care tools as per the types of hair extensions, which increases use costs and storage burdens.

SUMMARY OF THE DISCLOSURE

An advantage of this utility model is that a hair extension care apparatus is provided, where the hair extension care apparatus resolves a problem of a limited application scope of a conventional hair extension care apparatus and can meet care needs of different hair extensions.

Another advantage of this utility model is that a hair extension care apparatus is provided, where the hair extension care apparatus is provided with a sparse-tooth component and a dense-tooth component, which expands an application scope of the hair extension care apparatus and facilitates compatibility with multiple types of hair extensions.

Still another advantage of this utility model is that a hair extension care apparatus is provided, where the hair extension care apparatus has both the sparse-tooth component and the dense-tooth component, so that hanging, combing, and drying of different types of hair extensions can be completed without changing of tools, thereby simplifying an operation process and improving care efficiency.

Yet another advantage of this utility model is that a hair extension care apparatus is provided, where the sparse-tooth component and the dense-tooth component of the hair extension care apparatus can be detachably disposed, so that installation and detachment of the sparse-tooth component and the dense-tooth component can be selected based on an actual need, thereby implementing diversified functions.

Still yet another advantage of this utility model is that a hair extension care apparatus is provided, where the dense-tooth component of the hair extension care apparatus is disposed above the sparse-tooth component. This facilitates fine fixation of a hair root of the hair extension, which not only ensures stability of an overall shape of the hair extension, but also facilitates operations such as combing and dyeing of a hair strand body and a hair end of the hair extension, thereby optimizing layered care from the hair root to the hair end.

A further advantage of this utility model is that a hair extension care apparatus is provided, where the dense-tooth component and the sparse-tooth component of the hair extension care apparatus are disposed on a same horizontal line, so that the hair extension care apparatus has a more compact overall structure and occupies less space, thereby making the hair extension care apparatus suitable for a portable scenario or a small-sized storage environment.

A still further advantage of this utility model is that a hair extension care apparatus is provided, where the dense-tooth component of the hair extension care apparatus is adjustably disposed between the sparse-tooth components, that is, at least one adjustable dense-tooth unit is added between two sparse-tooth units, to implement dynamic adjustment of tooth spacing and meet requirements of different hair extensions for support densities, thereby avoiding slipping or deformation of the hair extension caused due to fixed tooth spacing.

A yet further advantage of this utility model is that a hair extension care apparatus is provided, where the hair extension care apparatus provides diversified wall fixing methods, to meet installation requirements in different scenarios, which enhances diversity of applicable environments of the apparatus.

According to another aspect of this utility model, this utility model further provides a hair extension care apparatus, where the hair extension care apparatus includes:

an installation frame;

a sparse-tooth component; and a dense-tooth component, where both the sparse-tooth component and the dense-tooth component are installed on the installation frame to fix a hair extension.

According to an embodiment of this utility model, the dense-tooth component includes a dense-tooth connecting portion and a dense-tooth portion, the dense-tooth portion is connected to the dense-tooth connecting portion, and the dense-tooth portion is detachably connected to the installation frame through the dense-tooth connecting portion.

According to an embodiment of this utility model, the dense-tooth portion includes multiple dense-tooth units and multiple dense-tooth gaps located between pairs of the dense-tooth units, and the multiple dense-tooth units are arranged at the dense-tooth connecting portion.

According to an embodiment of this utility model, the sparse-tooth component includes a sparse-tooth connecting portion and a sparse-tooth portion, the sparse-tooth portion is connected to the sparse-tooth connecting portion, and the sparse-tooth portion is connected to the installation frame through the sparse-tooth connecting portion.

According to an embodiment of this utility model, the sparse-tooth portion includes multiple sparse-tooth units and multiple sparse-tooth gaps located between pairs of the sparse-tooth units, and the multiple sparse-tooth units are arranged on the installation frame.

According to an embodiment of this utility model, each sparse-tooth unit includes an extension portion and a bent portion, and the bent portion is integrally bent and extended outward from the extension portion.

According to an embodiment of this utility model, a transverse length of the sparse-tooth gap is greater than a transverse length of the dense-tooth gap.

According to an embodiment of this utility model, the installation frame includes an installation component and a cover component, and has installation space, a side of the cover component is rotatably connected to the installation component, to form the installation space between the installation component and the cover component, and both the sparse-tooth component and the dense-tooth component are fixed on the installation component and located in the installation space.

According to an embodiment of this utility model, the installation component has an inner plate, a side plate disposed around the inner plate, and a bottom plate connected to a lower portion of the inner plate, the sparse-tooth component is fixed on the bottom plate, and the dense-tooth component is detachably installed on the inner plate.

According to an embodiment of this utility model, the installation component has an inner plate, a side plate disposed around the inner plate, and a bottom plate connected to a lower portion of the inner plate, the sparse-tooth component is detachably installed on the bottom plate, and the dense-tooth component is detachably installed on the inner plate.

According to an embodiment of this utility model, both the dense-tooth component and the sparse-tooth component are installed on the installation component, and the dense-tooth component is installed above the sparse-tooth component.

According to an embodiment of this utility model, the sparse-tooth component and the dense-tooth component are disposed side by side on the installation frame, and the dense-tooth component and the sparse-tooth component are disposed on a same horizontal line.

According to an embodiment of this utility model, the dense-tooth unit is pivotally connected between each pair of sparse-tooth units through the dense-tooth connecting portion.

According to an embodiment of this utility model, the dense-tooth component further includes multiple connecting members, and the connecting members are extended from the dense-tooth connecting portion to connect and fix the installation component.

According to an embodiment of this utility model, the installation component has multiple connecting member clamping holes for installing the connecting members, each connecting member clamping hole has a bigger hole and a smaller hole, the bigger hole and the smaller hole communicate with each other, and the connecting member is suitable for entering through the bigger hole and sliding into the smaller hole to complete clamping and fixing.

According to an embodiment of this utility model, the installation frame further includes a fixing component, the fixing component includes at least one suspension arm and multiple attraction components, and all the suspension arm and attraction components are detachably installed on the installation component.

According to an embodiment of this utility model, the suspension arm is installed on the installation component, and the suspension arm has one end detachably connected to the installation component and has another end bent and extended to fix the installation component and the cover component on a rod body.

According to an embodiment of this utility model, the installation component further has two installation holes, the two installation holes are respectively extended outward from a surface of the inner plate to penetrate through the inner plate, and ends of the two suspension arms are suitable for being inserted into the installation hole.

According to an embodiment of this utility model, each attraction component includes an attraction unit, a connecting rod, and a fixing unit, the attraction unit is connected to a front end of the connecting rod, and the fixing unit is suitable for being installed on the connecting rod to fix the connecting rod on the installation component.

According to an embodiment of this utility model, the installation component further has multiple attraction holes corresponding to the attraction components, the attraction holes are extended outward from the inner plate of the installation component to penetrate through the inner plate, and the connecting rod is suitable for passing through the attraction hole and being fixed by the fixing unit.

Other objectives and advantages of this utility model may be fully embodied through an understanding of the following description and accompanying drawings.

DETAILED DESCRIPTION

The following description is intended to disclose this utility model, so that those skilled in the art can implement this utility model. The preferred embodiments in the following description are merely examples, and those skilled in the art may figure out other obvious variations. The basic principles of this utility model that are defined in the following description may be applied to other implementation solutions, modified solutions, improved solutions, equivalent solutions and other technical solutions that do not depart from the spirit and scope of this utility model.

Those skilled in the art should understand that the terms "longitudinal", "transverse", "upper", "lower", "front", "rear", "left", "right", "vertical", "horizontal", "top", "bottom", "inner", "outer" and the like disclosed in this utility model indicate orientations or positional relationships based on the orientations or positional relationships shown in the figures, are intended merely for convenience in describing this utility model and simplifying description, and do not indicate or imply that the referenced apparatuses or elements must have a particular orientation or be constructed and operated in a particular orientation, and therefore, the foregoing terms should not be construed as limitations on this utility model.

It can be understood that the term "a" or "an" should be construed as "at least one" or "one or more". That is, in an embodiment, an element may refer to one element, while in other embodiments, an element may refer to multiple elements. The term "a" or "an" shall not be construed as a limitation on the quantity.

FIG. 1 to FIG. 9 schematically show a hair extension care apparatus according to an embodiment of this utility model. The hair extension care apparatus 1 is mainly used for hanging a hair extension to facilitate care operations such as cleaning, combing, and drying. Specifically, in this embodiment of this application, the hair extension care apparatus 1 resolves a problem of a limited application scope of a conventional hair extension care apparatus, is suitable for hanging and combing a hair extension or hair weft with a small transverse length, and can meet care needs of different hair extensions.

Figure 1:
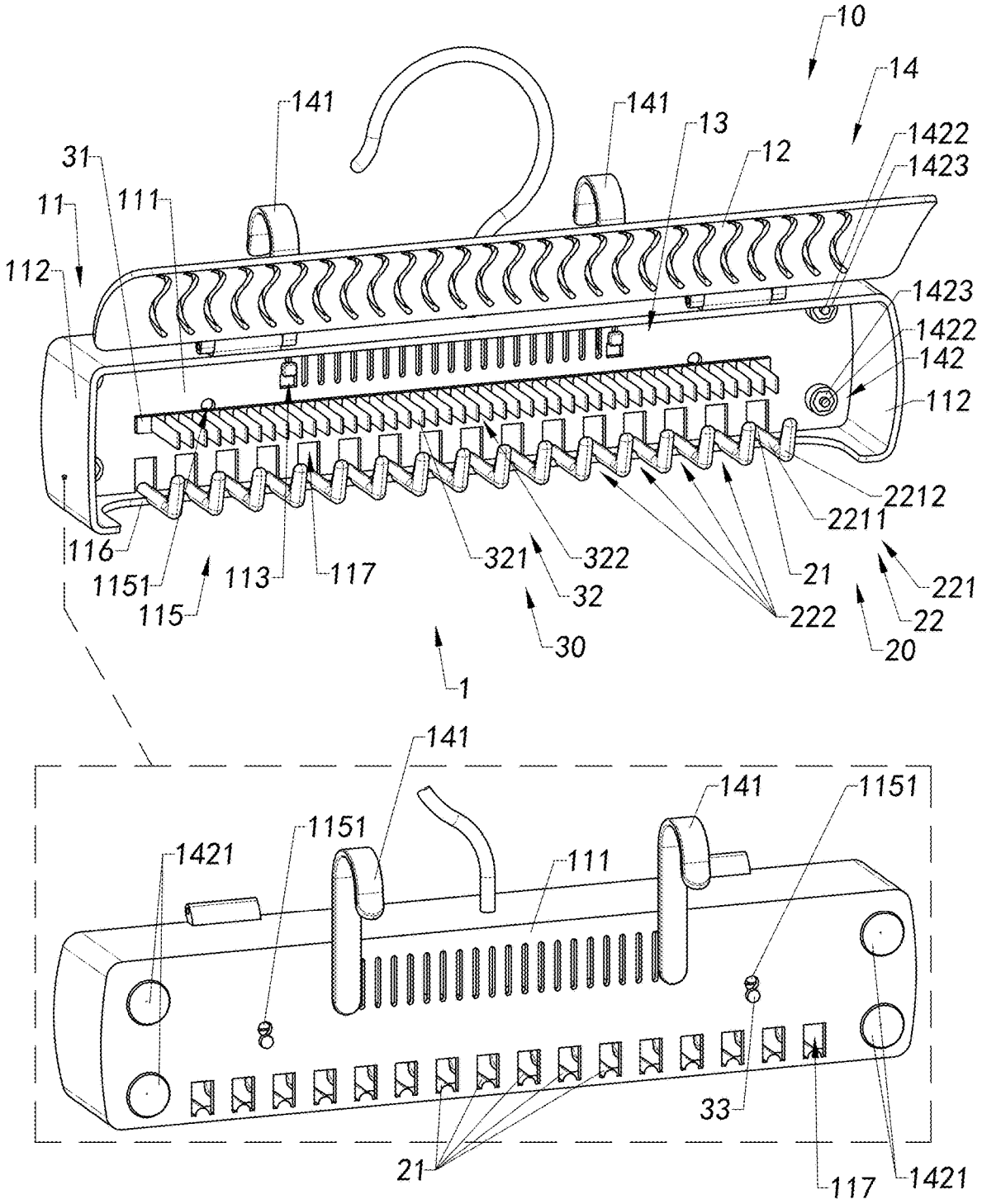
FIG. 1 is a schematic diagram of an overall structure of a hair extension care apparatus according to Embodiment 1 of this utility model.

FIG. 1 is a schematic diagram of an overall structure of a hair extension care apparatus 1 according to Embodiment 1 of this utility model. In this embodiment, the hair extension care apparatus 1 includes an installation frame 10, a sparse-tooth component 20, and a dense-tooth component 30, where both the sparse-tooth component 20 and the dense-tooth component 30 are installed on the installation frame 10 to fix a hair extension. In this embodiment, the sparse-tooth component 20 is fixed on the installation frame 10, and the dense-tooth component 30 is detachably installed on the installation frame 10. In another possible embodiment, both the sparse-tooth component 20 and the dense-tooth component 30 are detachably installed on the installation frame 10. This is not limited in this utility model. Specifically, a root portion of the hair extension is suitable for being hung on the sparse-tooth component 20 or the dense-tooth component 30, and a hair strand body and a hair end of the hair extension naturally hang down from the sparse-tooth component 20 or the dense-tooth component 30, which facilitates operations such as combing and dyeing of the hair strand body and the hair end of the hair extension, thereby optimizing layered care from the hair root to the hair end.

Figure 2:
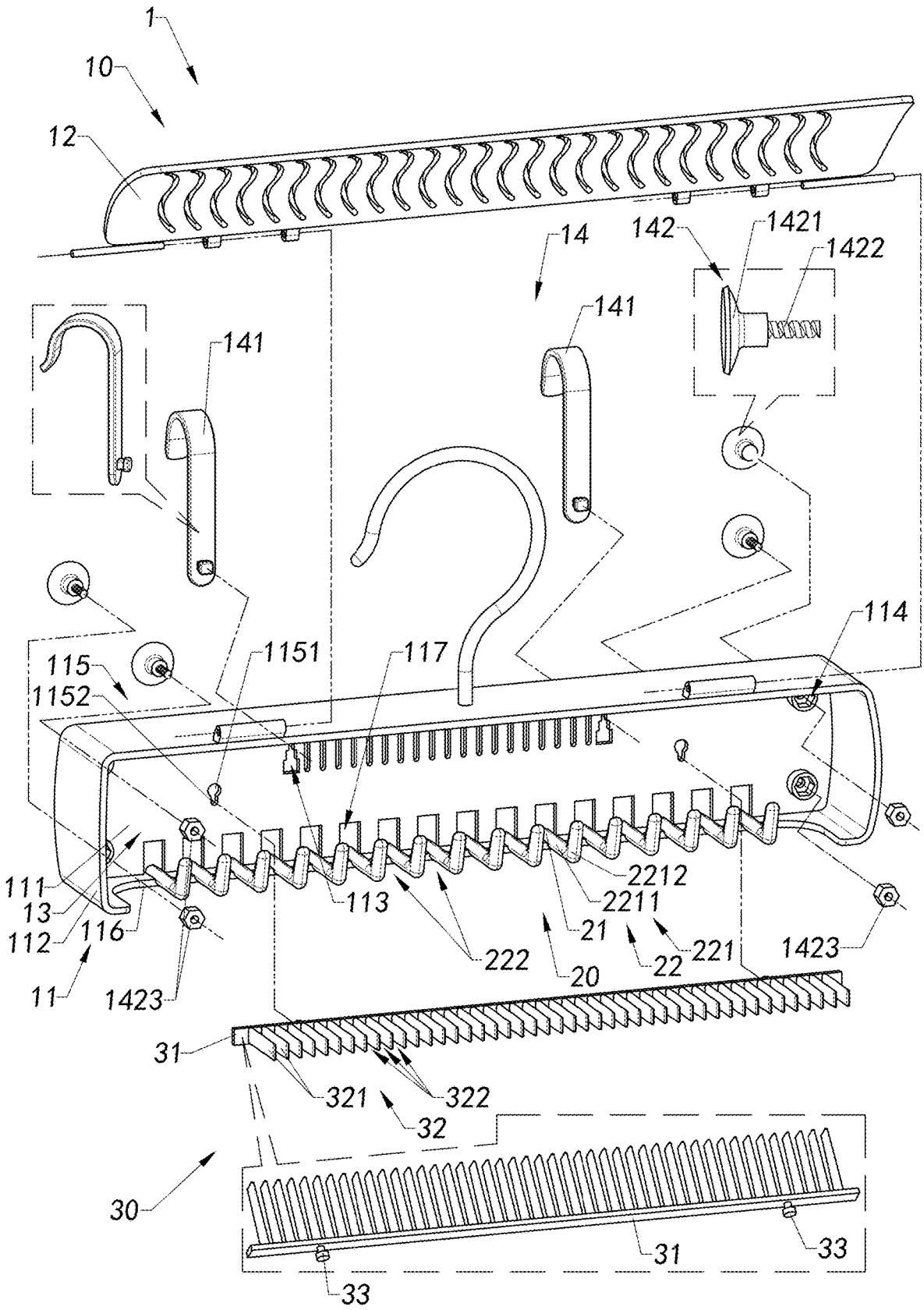
FIG. 2 is a schematic exploded view of a hair extension care apparatus according to Embodiment 1 of this utility model.

FIG. 2 is a schematic exploded view of a hair extension care apparatus 1 according to an embodiment of this utility model. The installation frame 10 includes an installation component 11 and a cover component 12, and has installation space 13, a side of the cover component 12 is rotatably connected to the installation component 11, to form the installation space 13 between the installation component 11 and the cover component 12. In this embodiment, preferably, both the sparse-tooth component 20 and the dense-tooth component 30 are fixed on the installation component 11 and located in the installation space 13. After the cover component 12 is rotated relative to the installation component 11 and opened, the sparse-tooth component 20 and the dense-tooth component 30 are exposed from the installation space 13 to hang the hair extension.

The installation component 11 has an inner plate 111, a side plate 112 disposed around the top and two sides of the inner plate 111, and a bottom plate 116 connected to a lower portion of the inner plate 111. In this embodiment, the sparse-tooth component 20 is fixed on the bottom plate 116, for example, the sparse-tooth component 20 and the inner plate 111 are formed via injection molding, and the dense-tooth component 30 is detachably installed on the inner plate 111. In another possible embodiment, both the sparse-tooth component 20 and the dense-tooth component 30 are fixed on the inner plate 111 of the installation component 11. Preferably, the sparse-tooth component 20 is disposed at a position on a lower portion of the inner plate 111 of the installation component 11, and the dense-tooth component 30 is disposed at a position in the middle of the inner plate 111 of the installation component 11.

In particular, in this embodiment, both the sparse-tooth component 20 and the dense-tooth component 30 are fixed on the installation component 11, and the dense-tooth component 30 is installed above the sparse-tooth component 20. In another possible embodiment, the dense-tooth component 30 may alternatively be installed below the sparse-tooth component 20. In another possible embodiment, the dense-tooth component 30 and the sparse-tooth component 20 may alternatively be disposed side by side. Those skilled in the art should understand that relative positions of the dense-tooth component 30 and the sparse-tooth component 20 are not limited in this utility model.

Figure 6:
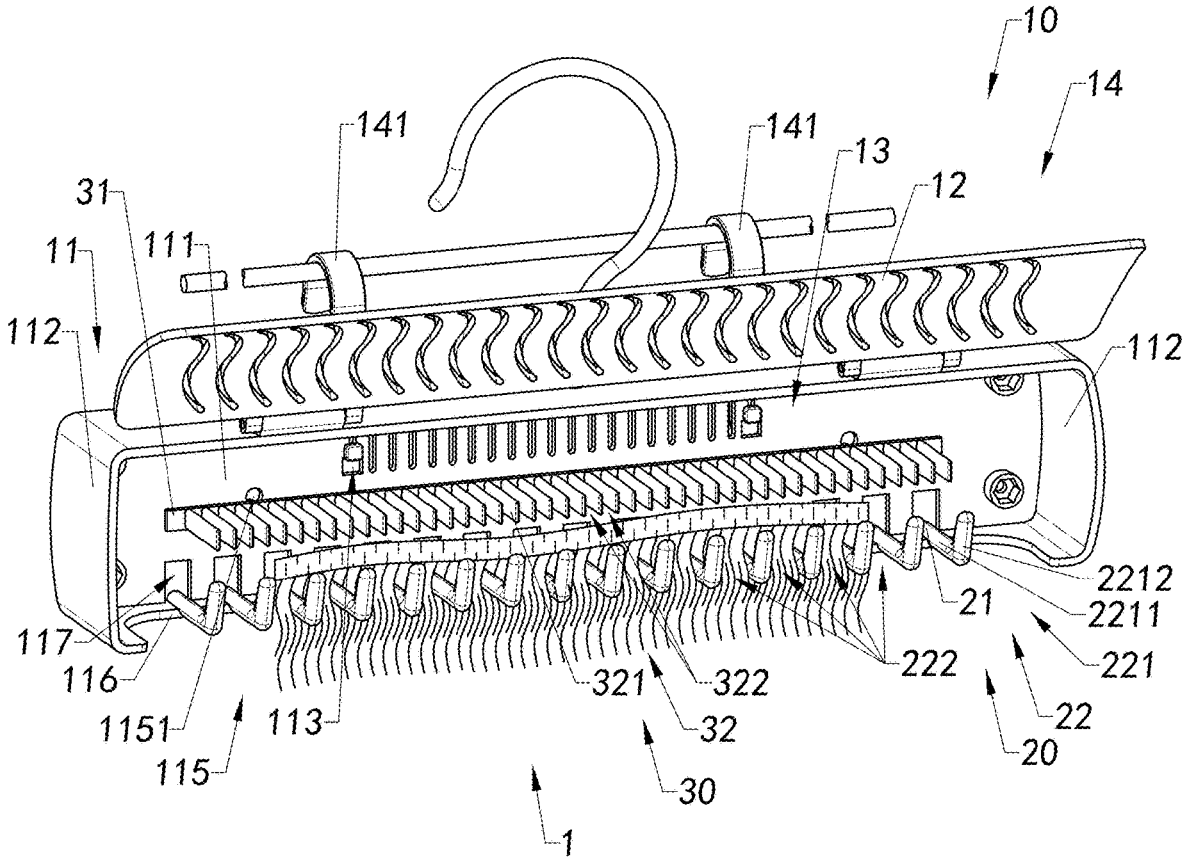
FIG. 6 is a first schematic diagram indicating that a hair extension is hung on a hair extension care apparatus according to Embodiment 1 of this utility model.
Figure 7:
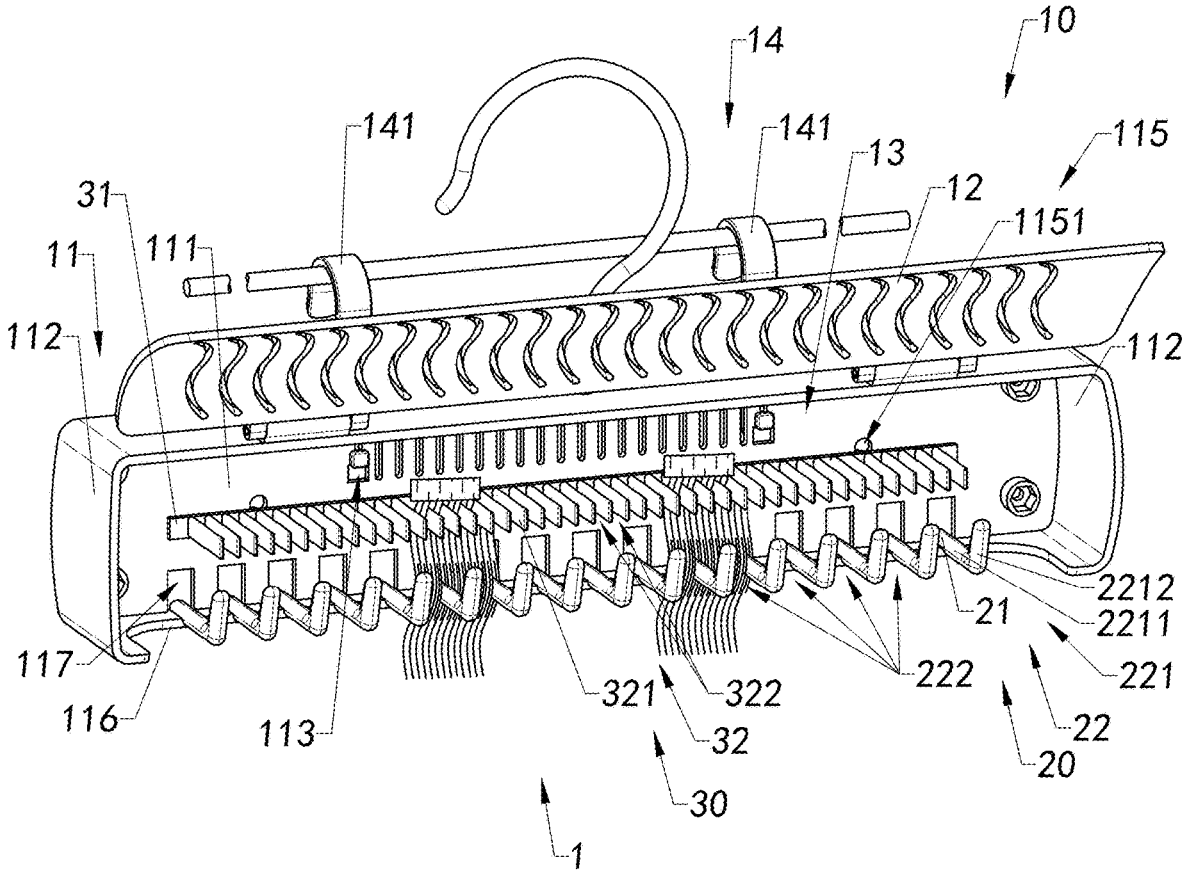
FIG. 7 is a second schematic diagram indicating that a hair extension is hung on a hair extension care apparatus according to Embodiment 1 of this utility model.

FIG. 6 and FIG. 7 are schematic diagrams indicating that a hair extension is hung on a hair extension care apparatus 1 according to an embodiment of this utility model. A user can choose to hang the hair extensions on the sparse-tooth component 20 or the dense-tooth component 30 as per different types of hair extensions. For example, a hair extension with a greater transverse length is hung and fixed on the sparse-tooth component 20; and a hair extension with a smaller transverse length is hung and fixed on the dense-tooth component 30. This facilitates fine fixation of the hair root of the hair extension, which not only ensures stability of an overall shape of the hair extension, but also facilitates operations such as combing and dyeing of the hair end of the hair extension, thereby optimizing layered care from the hair root to the hair end.

In particular, the sparse-tooth component 20 includes a sparse-tooth connecting portion 21 and a sparse-tooth portion 22, the sparse-tooth portion 22 is connected to the sparse-tooth connecting portion 21, and two ends of the sparse-tooth connecting portion 21 are respectively connected to the sparse-tooth portion 22 and the bottom plate 116 of the installation component 11. In other words, the sparse-tooth portion 22 is fixed on the bottom plate 116 of the installation component 11 via the sparse-tooth connecting portion 21. In this embodiment, a portion at which the sparse-tooth component 20 and the bottom plate 116 are fixed to each other is defined as the sparse-tooth connecting portion 21, and the sparse-tooth portion 22 is extended outward integrally from the sparse-tooth connecting portion 21. In addition, in another possible embodiment, the sparse-tooth connecting portion 21 is detachably connected to the installation component 11 through clamping. In another possible embodiment, the sparse-tooth connecting portion 21 may alternatively be detachably connected to the installation component 11 through magnetic attraction, negative pressure suction, threaded connection, or adhesion. This is not limited in this utility model.

Specifically, the sparse-tooth portion 22 includes multiple sparse-tooth units 221 and multiple sparse-tooth gaps 222 between pairs of sparse-tooth units 221, and the multiple sparse-tooth units 221 are arranged on the sparse-tooth connecting portion 21. In other words, the sparse-tooth units 221 are extended outward from the sparse-tooth connecting portion 21 to fix the hair root of the hair extension. Preferably, the quantity of sparse-tooth units 221 is set to 15 to 25 to meet a fixing requirement of hair roots of the hair extension.

More specifically, when the hair extension is hung on the sparse-tooth component 20, the hair root of the hair extension is supported by the sparse-tooth unit 221, and the hair extension naturally hangs down through the sparse-tooth gap 222, which facilitates operations such as combing and dyeing of the hair end of the hair extension, thereby optimizing layered care from the hair root to the hair end.

The dense-tooth component 30 includes a dense-tooth connecting portion 31 and a dense-tooth portion 32, the dense-tooth portion 32 is connected to the dense-tooth connecting portion 31, and two ends of the dense-tooth connecting portion 31 are respectively connected to the dense-tooth portion 32 and the inner plate 111 of the installation component 11. In other words, the dense-tooth portion 32 is detachably connected to the inner plate 111 of the installation component 11 via the dense-tooth connecting portion 31. In this embodiment, preferably, the dense-tooth connecting portion 31 is detachably connected to the inner plate 111 of the installation component 11 through clamping. In another possible embodiment, the dense-tooth connecting portion 31 may alternatively be detachably connected to the installation component 11 through magnetic attraction, negative pressure suction, threaded connection, or adhesion. This is not limited in this utility model.

Specifically, the dense-tooth portion 32 includes multiple dense-tooth units 321 and multiple dense-tooth gaps 322 between pairs of dense-tooth units 321, and the multiple dense-tooth units 321 are arranged on the dense-tooth connecting portion 31. In other words, the dense-tooth units 321 are extended outward from the dense-tooth connecting portion 31 to fix the hair root of the hair extension. Preferably, the quantity of dense-tooth units 321 is set to 80 to 100 to meet a fixing requirement of the hair roots of the hair extension. That is, in this embodiment, for the hair extension care apparatus 1, a transverse length is set to 20-40 cm, a vertical height is set to 5-10 cm, and a longitudinal depth is set to 3-8 cm. The specific dimensions are not limited in this utility model.

More specifically, when the hair extension is hung on the dense-tooth component 30, the hair root of the hair extension is supported by the dense-tooth unit 321, and the hair extension naturally hangs down through the dense-tooth gap 322, which facilitates operations such as combing and dyeing of the hair end of the hair extension, thereby optimizing layered care from the hair root to the hair end.

It is worth mentioning that a distance between each two sparse-tooth units 221 is greater than a distance between each two dense-tooth units 321. This structural difference is directly reflected in transverse dimensions of the sparse-tooth gap 222 and the dense-tooth gap 322. In other words, a transverse length of the sparse-tooth gap 222 is greater than a transverse length of the dense-tooth gap 322. With this differentiated spacing setting, the dense-tooth component 30 has a capability to adapt to a hair extension with a smaller transverse length, which can ensure that the hair extension with the smaller transverse length can be supported by the dense-tooth component 30 when the hair extension is hung, thereby effectively avoiding a problem that hair strands slip off or uneven force is applied due to excessively large tooth spacing. The sparse-tooth component 20 and the dense-tooth component 30 are functionally complementary, and therefore, the hair extension care apparatus 1 can be compatible with a wide range of hair extension types in the same structure, so that stable support and efficient care can be implemented for both the hair extension with the smaller transverse length and the hair extension with the greater transverse length, thereby significantly expanding a boundary of an application scenario for the hair extension care apparatus 1.

In this embodiment, the sparse-tooth unit 221 is configured in a hook shape, and the dense-tooth unit 321 is configured in a long strip shape. In another possible embodiment, the dense-tooth unit 321 may alternatively be configured in the hook shape, and the sparse-tooth unit 221 may alternatively be configured in the long strip shape. This is not limited in this utility model. Specifically, the sparse-tooth unit 221 includes an extension portion 2211 and a bent portion 2212, and the bent portion 2212 is integrally bent and extended outward from the extension portion 2211. When the hair extension is hung on the sparse-tooth unit 221, the bent portion 2212 can prevent the hair extension from falling off.

It is worth mentioning that the dense-tooth component 30 further includes multiple connecting members 33, the connecting members 33 are extended from the dense-tooth connecting portion 31 to connect and fix the installation component 11, and the installation component 11 has multiple connecting member clamping holes 115 for installing the connecting members 33. Preferably, in this embodiment, the quantity of connecting members 33 and the quantity of connecting member clamping holes 115 are both set to three. In another possible embodiment, the quantity of connecting members 33 and the quantity of connecting member clamping holes 115 can be altered. This is not limited in this utility model. Further, each connecting member clamping hole 115 has a bigger hole 1151 and a smaller hole 1152, the bigger hole 1151 and the smaller hole 1152 communicate with each other, and the connecting member 33 is suitable for entering through the bigger hole 1151 and sliding into the smaller hole 1152 to complete clamping and fixing.

Figure 8:
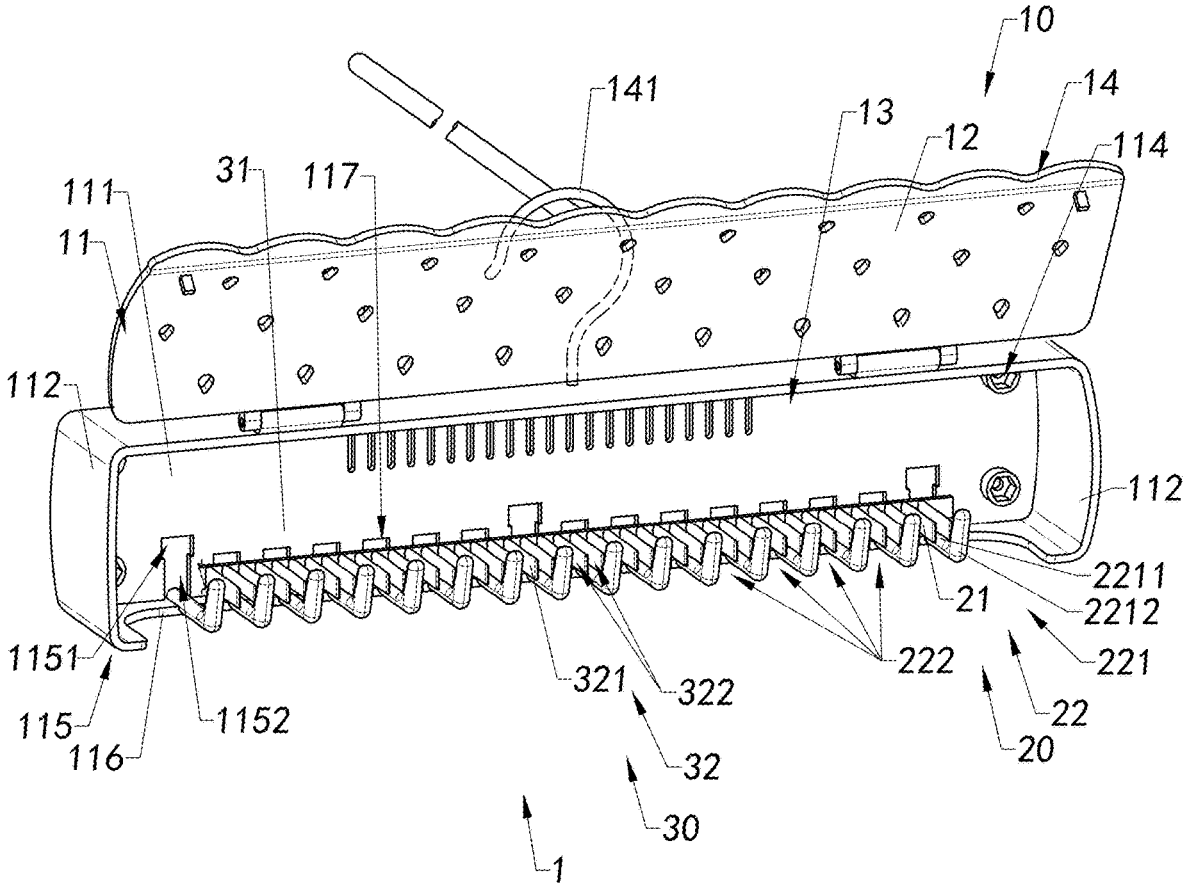
FIG. 8 is a schematic diagram of another embodiment of a connecting member clamping hole according to this utility model.

In this application, the installation component 11 further has multiple inner plate through holes 117, and the inner plate through holes 117 are arranged at the bottom of the inner plate 111. Specifically, the inner plate through holes 117 are extended upward from a joint of the bottom plate 116 and the inner plate 111, and each inner plate through hole 117 corresponds to one sparse-tooth unit 221. In a possible embodiment, the bigger hole 1151 and the smaller hole 1152 of the connecting member clamping hole 115 communicate with each other and are disposed in the inner plate 111. Preferably, in a possible embodiment, inner plate through holes 117 located at the leftmost, rightmost, and middle positions are defined as the connecting member clamping holes 115. FIG. 8 shows another embodiment of the connecting member clamping hole 115. Since the inner plate through holes 117 located at the leftmost, rightmost, and middle positions are defined as the connecting member clamping holes 115, compared with other inner plate through holes 117, each connecting member clamping hole 115 has the bigger hole 1151 and the smaller hole 1152, the bigger hole 1151 and the smaller hole 1152 communicate with each other, and the connecting member 33 is suitable for entering through the bigger hole 1151 and sliding into the smaller hole 1152 to complete clamping and fixing.

In this embodiment, the installation frame 10 further includes a fixing component 14, the fixing component 14 is installed on the installation component 11, and the installation component 11 and the cover component 12 are suitable for being fixed on a rod, a wall, or other places through the fixing component 14.

Figure 3:
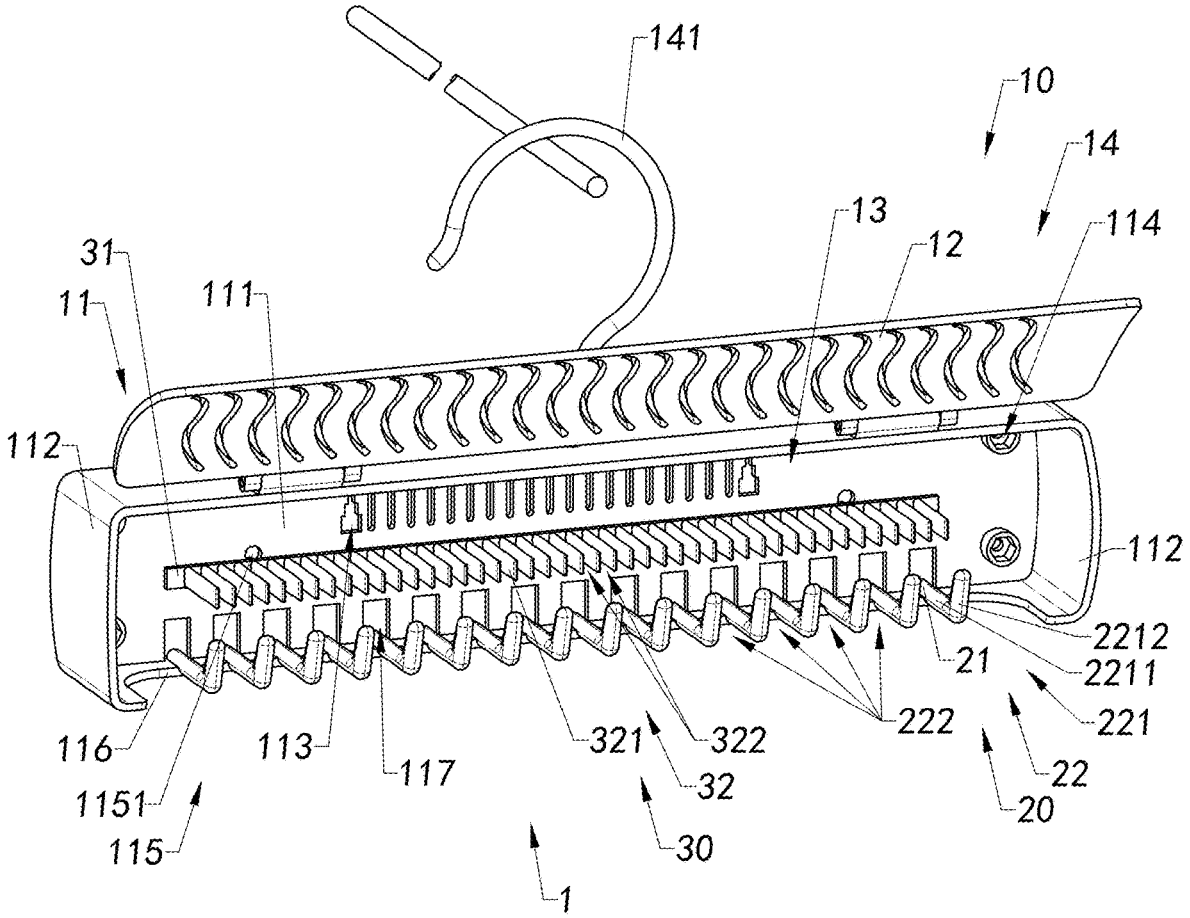
FIG. 3 is a first schematic diagram of an application scenario of a hair extension care apparatus according to Embodiment 1 of this utility model.
Figure 4:
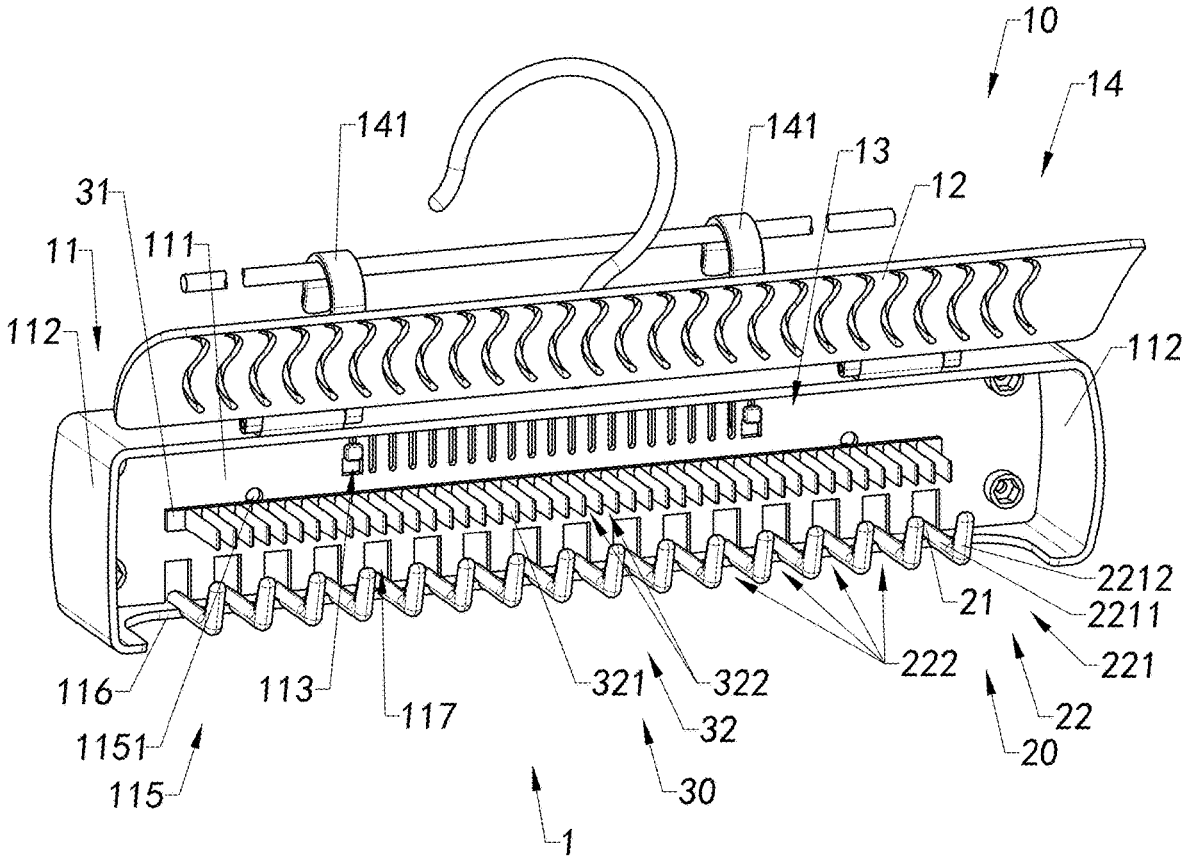
FIG. 4 is a second schematic diagram of an application scenario of a hair extension care apparatus according to Embodiment 1 of this utility model.

FIG. 3 is a first schematic diagram of an application scenario of a hair extension care apparatus 1 according to an embodiment of this utility model. FIG. 4 is a second schematic diagram of an application scenario of a hair extension care apparatus 1 according to an embodiment of this utility model. The figures show two embodiments of the fixing component 14. Specifically, the fixing component 14 includes a suspension arm 141 and multiple attraction components 142. The suspension arm 141 and the attraction components 142 are all detachably installed on the installation component 11 to fix the installation component 11 and the cover component 12 to a rod, a wall, or other places.

Specifically, as shown in FIG. 3, the suspension arm 141 is installed on the installation component 11, and the suspension arm 141 has one end detachably connected to the installation component 11 and has another end bent and extended into a hook shape to fix the installation component 11 and the cover component 12 on a rod body. In this embodiment, the suspension arm 141 can be configured to rotate by 360° to meet different suspension requirements.

More specifically, FIG. 4 is a second schematic diagram of an application scenario of a hair extension care apparatus 1 according to an embodiment of this utility model. In this embodiment, the suspension arm 141 is connected to the inner plate 111 of the installation component 11. In another possible embodiment, the suspension arm 141 is connected to the side plate 112 of the installation component 11. Preferably, in this embodiment, the quantity of suspension arms 141 is set to two, the installation component 11 further has two installation holes 113, the two installation holes 113 are respectively extended outward from a surface of the inner plate 111 to penetrate through the inner plate 111, and ends of the two suspension arms 141 are suitable for being inserted into the installation hole 113. The installation hole 113 is tapered, that is, a diameter of an upper portion of the installation hole 113 is greater, and a diameter of a lower portion of the installation hole 113 is smaller. An end of the suspension arm 141 is suitable for entering from the upper portion of the installation hole 113 and sliding to the lower portion of the installation hole 113 to be clamped, thereby achieving a fixing effect. In another possible embodiment, a diameter of a lower portion of the installation hole 113 is greater, and a diameter of an upper portion of the installation hole 113 is smaller. An end of the suspension arm 141 is suitable for entering from the lower portion of the installation hole 113 and sliding to the upper portion of the installation hole 113 to be clamped, thereby achieving a fixing effect. This is not limited in this utility model.

Figure 5:
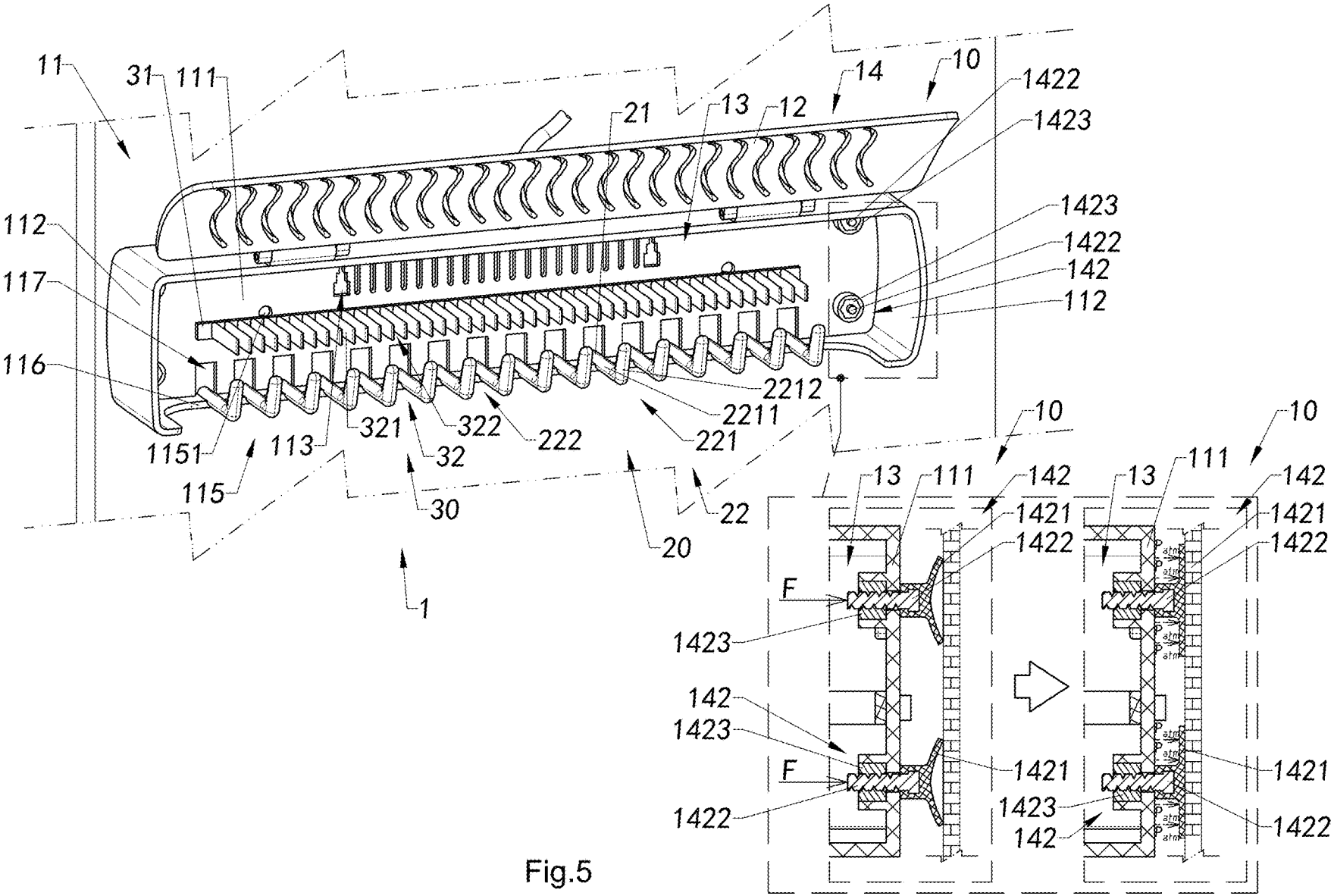
FIG. 5 is a third schematic diagram of an application scenario of a hair extension care apparatus according to Embodiment 1 of this utility model.

As shown in FIG. 5, FIG. 5 is a third schematic diagram of an application scenario of a hair extension care apparatus 1 according to an embodiment of this utility model. Each attraction component 142 includes an attraction unit 1421, a connecting rod 1422, and a fixing unit 1423, the installation component 11 has multiple corresponding attraction holes 114, the attraction holes 114 are extended outward from the inner plate 111 of the installation component 11 to penetrate through the inner plate 111, the attraction unit 1421 is connected to a front end of the connecting rod 1422, and the connecting rod 1422 is suitable for passing through the attraction hole 114 and being fixed by the fixing unit 1423. Specifically, in this embodiment, the fixing unit 1423 and the connecting rod 1422 are connected via threads. That is, a surface of the connecting rod 1422 is provided with an external thread, the fixing unit 1423 is provided with a matched internal thread, and the threads are engaged together to achieve a fixing effect. In addition, in this embodiment, four such attraction components 142 are disposed, and the four attraction components 142 are respectively disposed at four corners of the installation component 11, to stably fix the installation component 11 and the cover component 12 to a wall surface or other places through an attraction operation.

Figure 9:
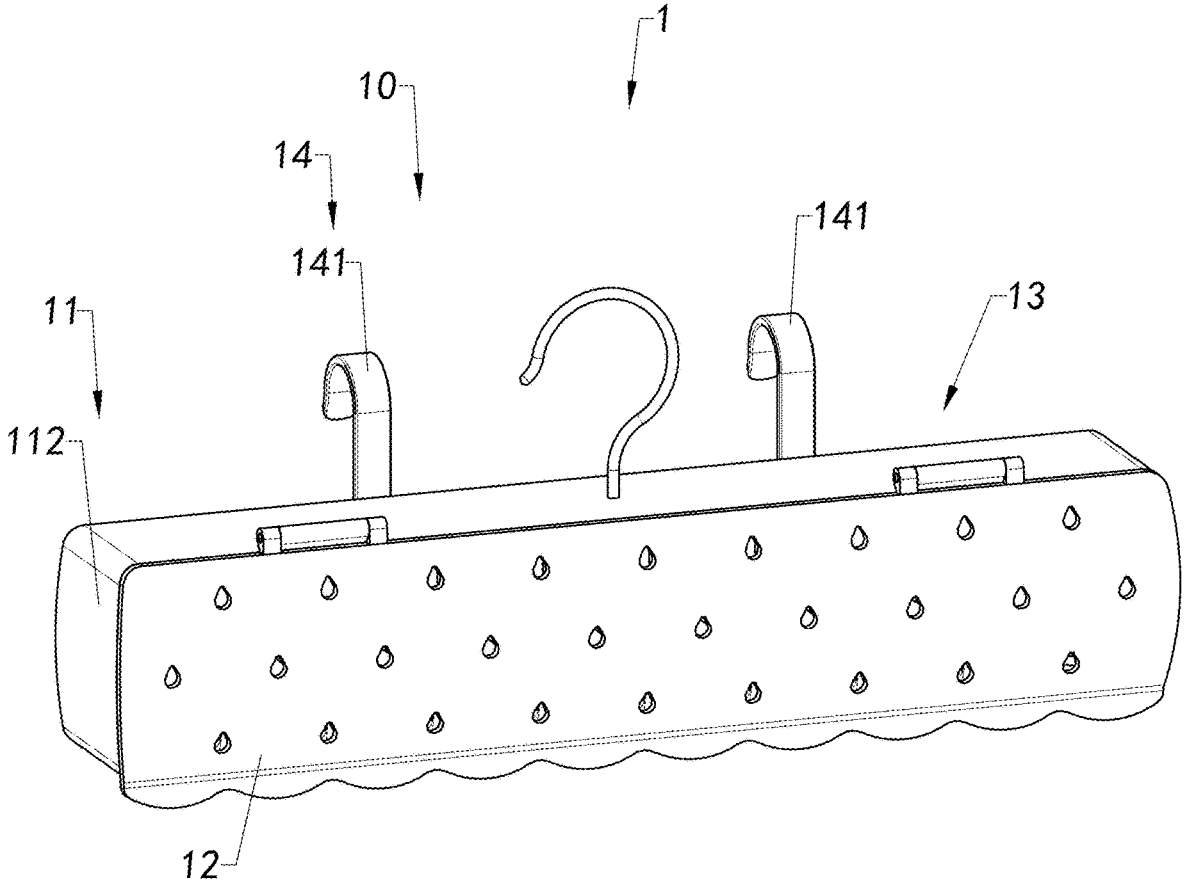
FIG. 9 is a schematic diagram of a closed state of a cover component of a hair extension care apparatus according to this utility model.

In addition, multiple hollowed-out patterns are provided in surfaces of the installation component 11 and the cover component 12, to reduce weight of the installation frame 10 and facilitate entry of an external air flow into the installation space 13. FIG. 9 is a schematic diagram of a closed state of a cover component of a hair extension care apparatus according to this utility model. As shown in the figure, the cover component 12 is further provided with a buckle. Preferably, one buckle is disposed on each side of the cover component 12, and the cover component 12 may be fixed on the bottom plate 116 or the side plate 112 via the buckle. The user can easily open and close the cover component 12 by operating the buckle, which implements a balance between structural stability and operational convenience.

In summary, the hair extension care apparatus 1 is provided with the sparse-tooth component 20 and the dense-tooth component 30, which expands the application scope of the hair extension care apparatus. Such design facilitates compatibility with multiple types of hair extensions, so that hanging, combing, and drying of different types of hair extensions can be completed without changing of tools, thereby simplifying an operation process and improving care efficiency.

Figure 10:
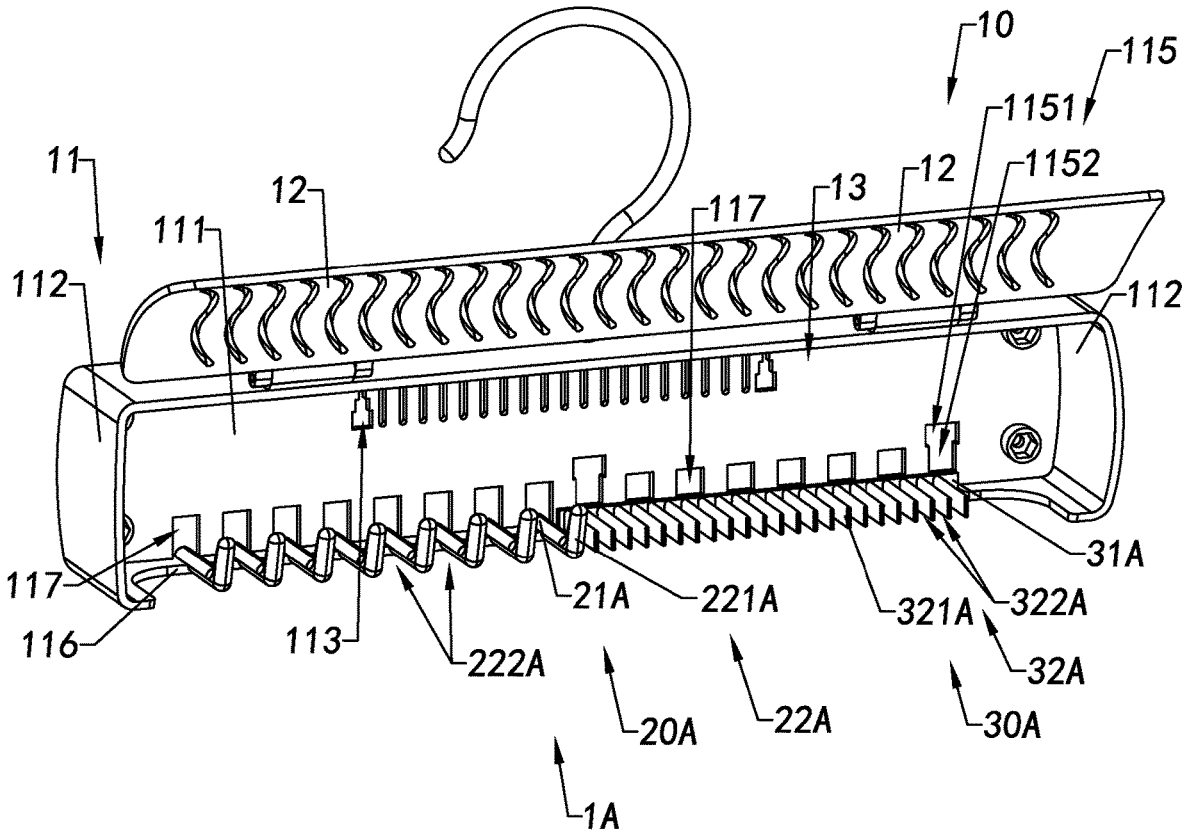
FIG. 10 is a schematic diagram of an overall structure of a hair extension care apparatus according to Embodiment 2 of this utility model.
Figure 11:
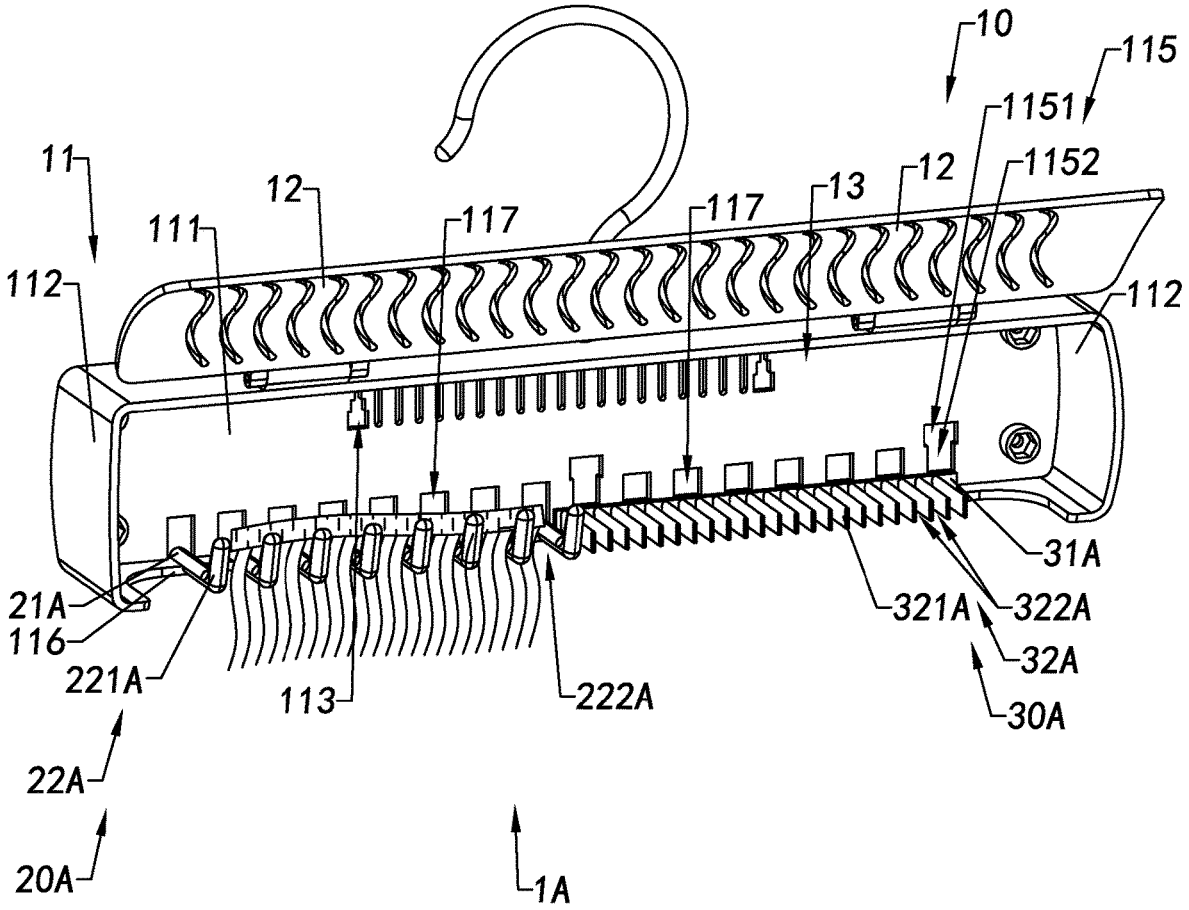
FIG. 11 is a first schematic diagram indicating that a hair extension is hung on a hair extension care apparatus according to Embodiment 2 of this utility model.
Figure 12:
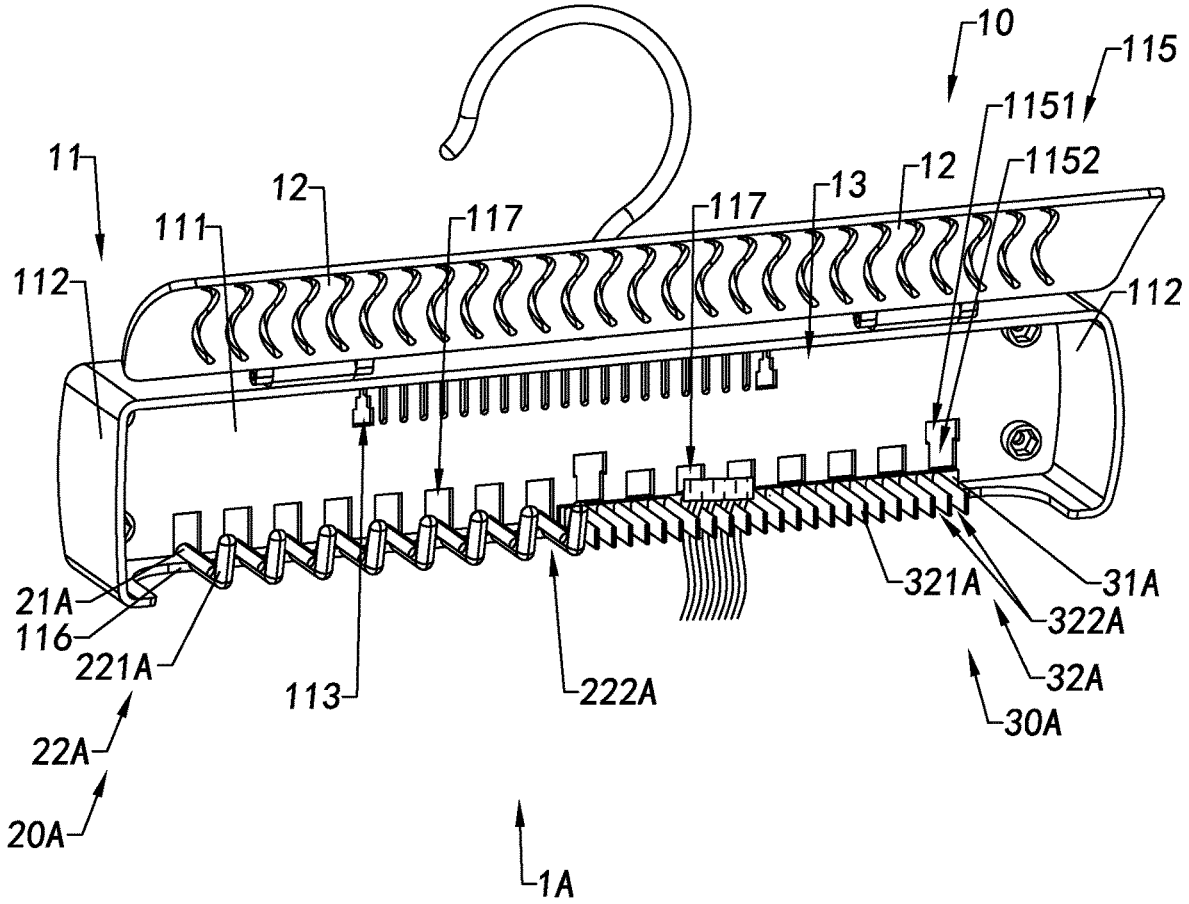
FIG. 12 is a second schematic diagram indicating that a hair extension is hung on a hair extension care apparatus according to Embodiment 2 of this utility model.

FIG. 10 to FIG. 12 illustrate a hair extension care apparatus 1A according to preferred Embodiment 2 of this utility model. In this preferred embodiment, the hair extension care apparatus 1A is a modified implementation of the foregoing preferred Embodiment 1. Compared with the foregoing preferred Embodiment 1, in this embodiment, relative positions of the sparse-tooth component 20A and the dense-tooth component 30A have been changed.

Likewise, in this embodiment, the hair extension care apparatus 1 includes an installation frame 10, a sparse-tooth component 20A, and a dense-tooth component 30A, where both the sparse-tooth component 20A and the dense-tooth component 30A are installed on the installation frame 10 to fix a hair extension. Preferably, both the sparse-tooth component 20A and the dense-tooth component 30A are detachably installed on the installation frame 10.

The installation frame 10 includes an installation component 11 and a cover component 12, and has installation space 13, a side of the cover component 12 is rotatably connected to the installation component 11, to form the installation space 13 between the installation component 11 and the cover component 12. The installation component 11 has an inner plate 111, a side plate 112 disposed around the inner plate 111, and a bottom plate 116 connected to a lower portion of the inner plate 111. The sparse-tooth component 20A is fixed on the bottom plate 116, for example, the sparse-tooth component 20A and the inner plate 111 are formed via injection molding, and the dense-tooth component 30A is detachably installed on the inner plate 111. In other embodiments, the dense-tooth component 30 and the inner plate 111 can alternatively be formed via injection molding.

A difference is that in this embodiment, the sparse-tooth component 20A and the dense-tooth component 30A are disposed side by side on the installation frame 10. In other words, the dense-tooth component 30A and the sparse-tooth component 20A are disposed on a same horizontal line, so that the hair extension care apparatus 1A has a more compact overall structure and occupies less space, thereby making the hair extension care apparatus suitable for a portable scenario or a small-sized storage environment.

Specifically, FIG. 10 is a schematic diagram of an overall structure of a hair extension care apparatus 1A according to Embodiment 2 of this utility model. The sparse-tooth component 20A includes a sparse-tooth connecting portion 21A and a sparse-tooth portion 22A, the sparse-tooth portion 22A is connected to the sparse-tooth connecting portion 21A, and two ends of the sparse-tooth connecting portion 21A are respectively connected to the sparse-tooth portion 22A and the bottom plate 116 of the installation component 11. In other words, the sparse-tooth portion 22A is fixedly connected to the bottom plate 116 of the installation component 11 via the sparse-tooth connecting portion 21A. In another possible embodiment, the sparse-tooth connecting portion 21A may alternatively be detachably connected to the bottom plate 116 of the installation component 11 through magnetic attraction, negative pressure suction, threaded connection, or adhesion. This is not limited in this utility model.

Specifically, the sparse-tooth portion 22A includes multiple sparse-tooth units 221A and multiple sparse-tooth gaps 222A between pairs of sparse-tooth units 221A, and the multiple sparse-tooth units 221A are arranged on the sparse-tooth connecting portion 21A. In other words, the sparse-tooth units 221A are extended outward from the sparse-tooth connecting portion 21A to fix the hair root of the hair extension.

The dense-tooth component 30A includes a dense-tooth connecting portion 31A and a dense-tooth portion 32A, the dense-tooth portion 32A is connected to the dense-tooth connecting portion 31A, and two ends of the dense-tooth connecting portion 31A are respectively connected to the dense-tooth portion 32A and the inner plate 111 of the installation component 11. In other words, the dense-tooth portion 32A is detachably connected to the inner plate 111 of the installation component 11 via the dense-tooth connecting portion 31A. In this embodiment, preferably, the dense-tooth connecting portion 31A is detachably connected to the inner plate 111 of the installation component 11 through clamping. In another possible embodiment, the dense-tooth connecting portion 31A may alternatively be detachably connected to the inner plate 111 of the installation component 11 through magnetic attraction, negative pressure suction, threaded connection, or adhesion. This is not limited in this utility model.

Specifically, the dense-tooth portion 32A includes multiple dense-tooth units 321A and multiple dense-tooth gaps 322A between pairs of dense-tooth units 321A, and the multiple dense-tooth units 321A are arranged on the dense-tooth connecting portion 31A. In other words, the dense-tooth units 321A are extended outward from the dense-tooth connecting portion 31A to fix the hair root of the hair extension. The dense-tooth component 30A further includes multiple above mentioned connecting members 33, and the connecting members 33 are extended from the dense-tooth connecting portion 31A to connect and fix the installation component 11.

The installation component 11 further has multiple inner plate through holes 117, and the inner plate through holes 117 are arranged at the bottom of the inner plate 111. Specifically, the inner plate through holes 117 are extended upward from a joint of the bottom plate 116 and the inner plate 111, and each inner plate through hole 117 corresponds to one sparse-tooth unit 221A or one dense-tooth unit 321A. In this embodiment, the dense-tooth portion 32A is detachably connected inside the bottom plate 116 through the dense-tooth connecting portion 31A and the connecting members 33A, and the connecting member 33 is inserted into the inner plate through hole 117. Likewise, the inner plate through hole 117 has a bigger hole 1151 and a smaller hole 1152, the bigger hole 1151 and the smaller hole 1152 communicate with each other, and the connecting member 33 is suitable for entering through the bigger hole 1151 and sliding into the smaller hole 1152 to complete clamping and fixing.

In particular, in this embodiment, the dense-tooth component 30A and sparse-tooth component 20A are disposed on a same horizontal line, so that the user can choose to hang the hair extension on the dense-tooth component 30A or the sparse-tooth component 20A based on a characteristic of the hair extension. In summary, the hair extension care apparatus 1A is provided with the sparse-tooth component 20A and the dense-tooth component 30A, which expands the application scope of the hair extension care apparatus. Such design facilitates compatibility with multiple types of hair extensions, so that hanging, combing, and drying of different types of hair extensions can be completed without changing of tools, thereby simplifying an operation process and improving care efficiency.

Figure 13:
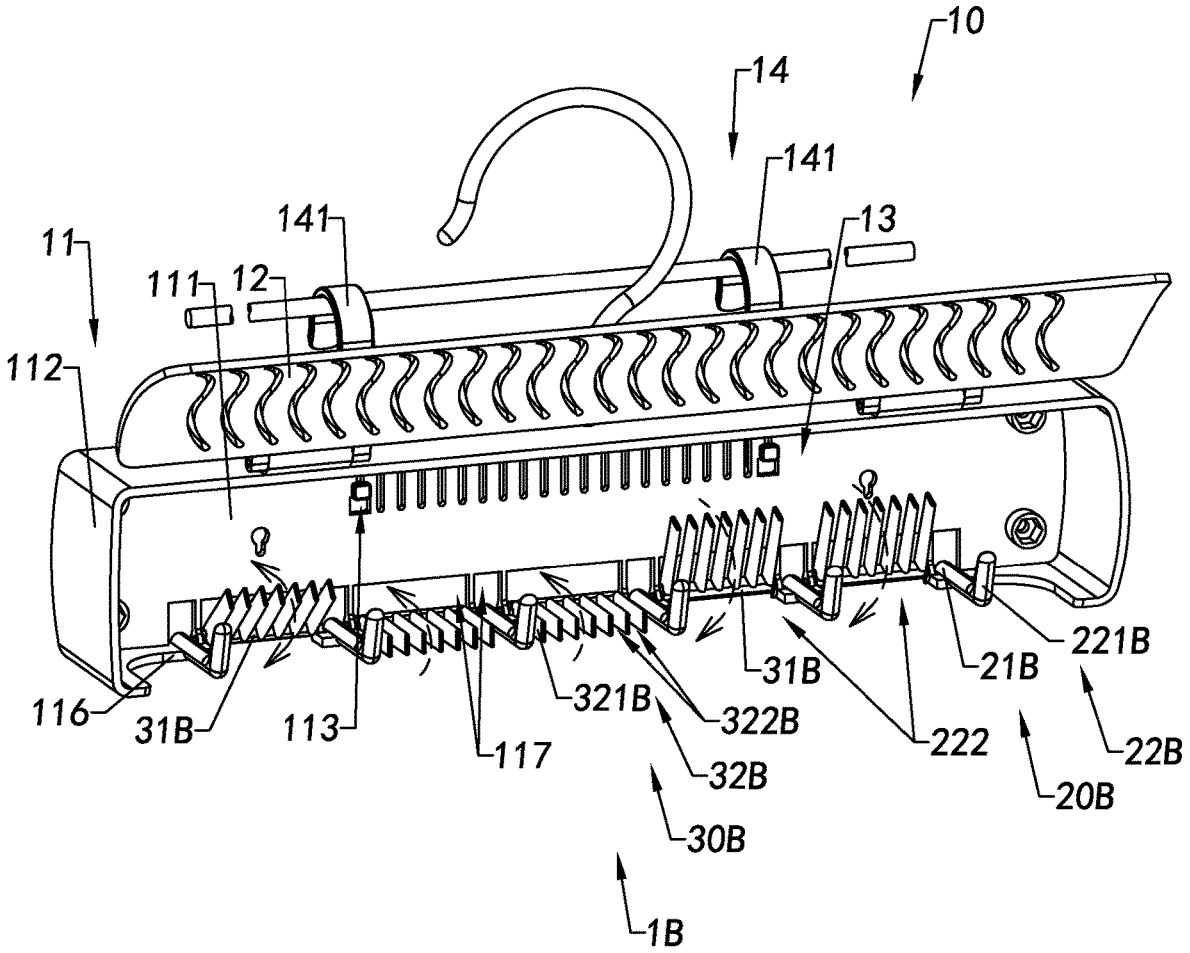
FIG. 13 is a schematic diagram of an overall structure of a hair extension care apparatus according to Embodiment 3 of this utility model.
Figure 14:
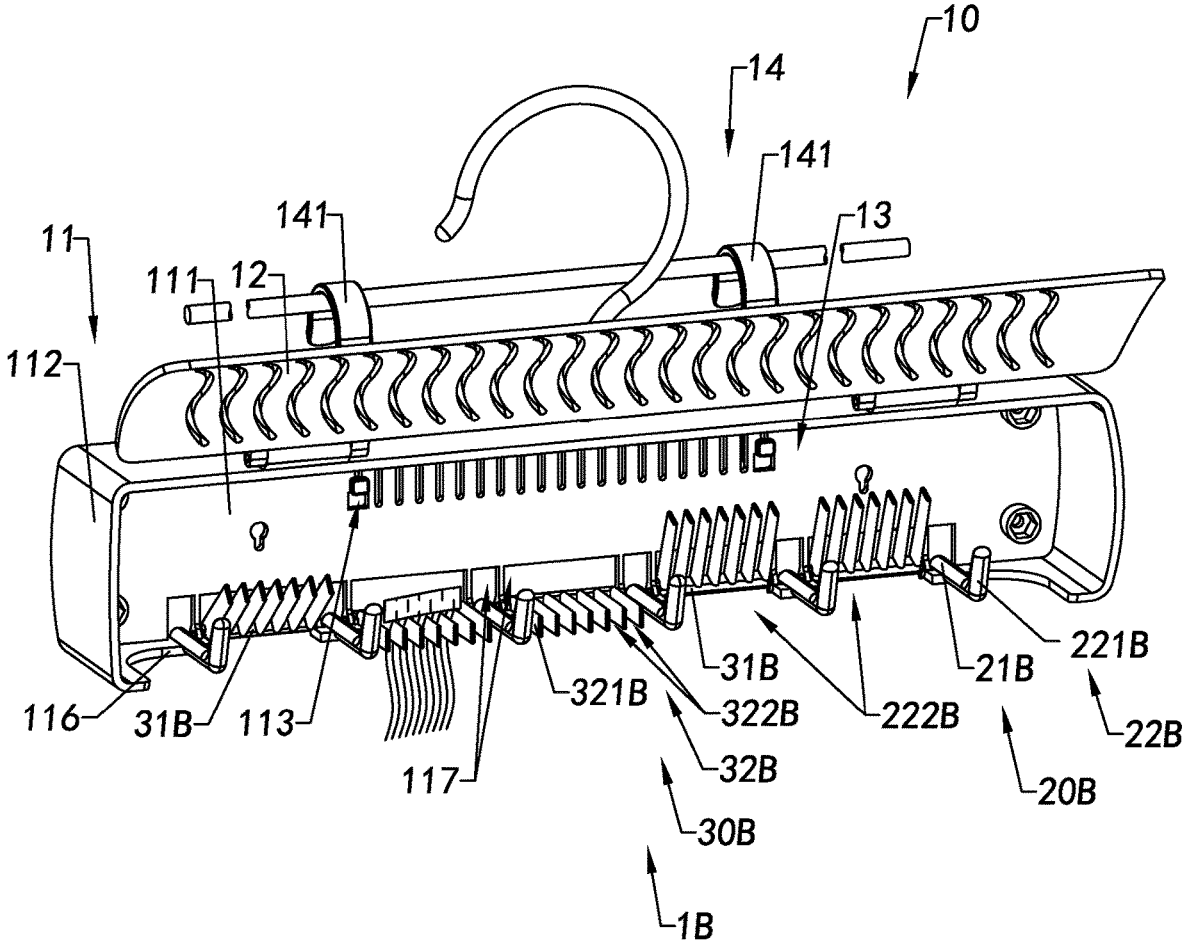
FIG. 14 is a first schematic diagram indicating that a hair extension is hung on a hair extension care apparatus according to Embodiment 3 of this utility model.
Figure 15:
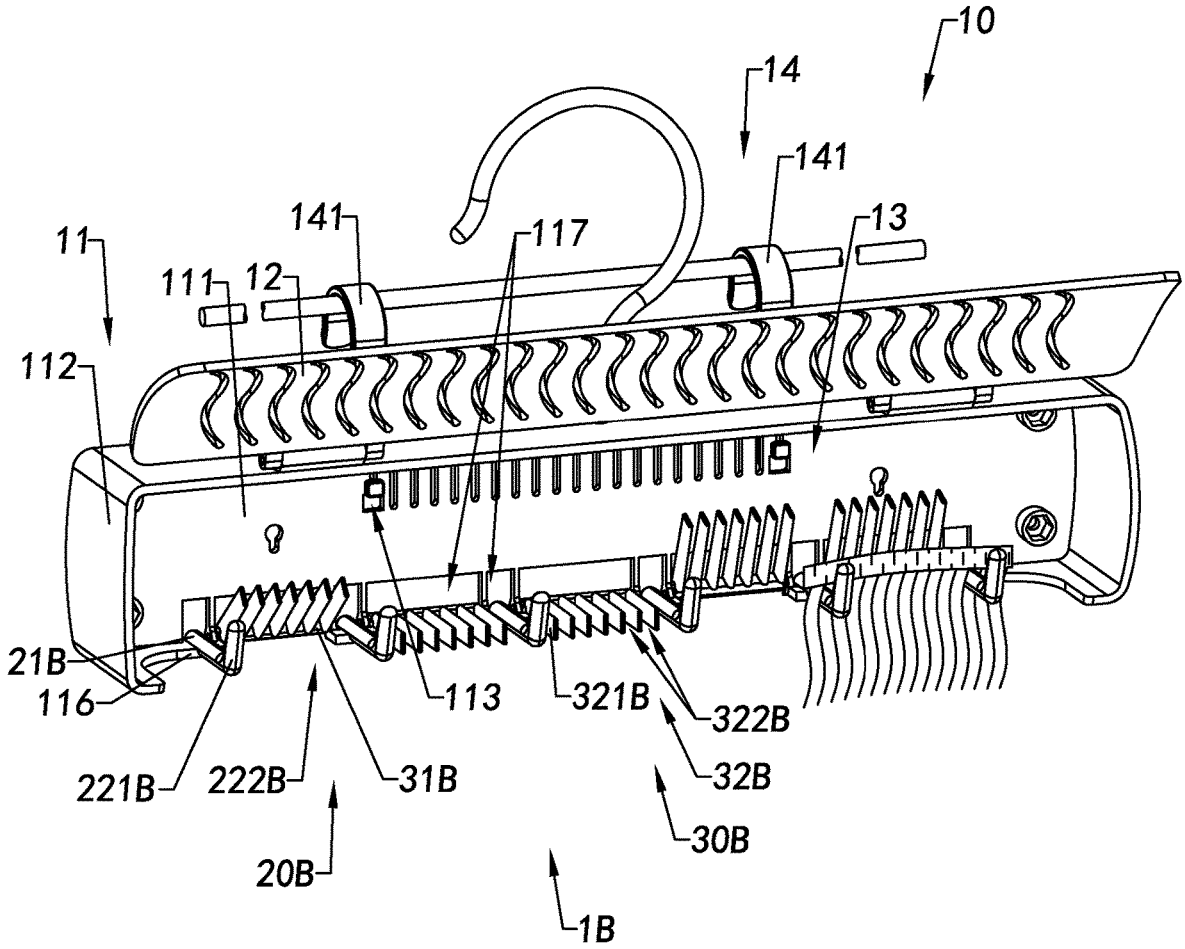
FIG. 15 is a second schematic diagram indicating that a hair extension is hung on a hair extension care apparatus according to Embodiment 3 of this utility model.

FIG. 13 to FIG. 15 illustrate a hair extension care apparatus 1B according to preferred Embodiment 3 of this utility model. In this preferred embodiment, the hair extension care apparatus 1B is a modified implementation of the foregoing preferred Embodiment 1. Compared with the foregoing preferred Embodiment 1, in this embodiment, relative positions of the sparse-tooth component 20B and the dense-tooth component 30B have been changed.

Likewise, in this embodiment, the hair extension care apparatus 1B includes an installation frame 10, a sparse-tooth component 20B, and a dense-tooth component 30B, where both the sparse-tooth component 20B and the dense-tooth component 30B are installed on the installation frame 10 to fix a hair extension. Preferably, both the sparse-tooth component 20B and the dense-tooth component 30B are detachably installed on the installation frame 10.

The installation frame 10 includes an installation component 11 and a cover component 12, and has installation space 13, a side of the cover component 12 is rotatably connected to the installation component 11, to form the installation space 13 between the installation component 11 and the cover component 12. The installation component 11 has an inner plate 111, a side plate 112 disposed around the inner plate 111, and a bottom plate 116 connected to a lower portion of the inner plate 111. The sparse-tooth component 20B is fixed on the bottom plate 116, for example, the sparse-tooth component 20B and the inner plate 111 are formed via injection molding, and the dense-tooth component 30B is detachably installed on the inner plate 111.

In particular, in this embodiment, as shown in FIG. 13, the sparse-tooth component 20B includes a sparse-tooth connecting portion 21B and a sparse-tooth portion 22B, the sparse-tooth portion 22B is connected to the sparse-tooth connecting portion 21B, and two ends of the sparse-tooth connecting portion 21B are respectively connected to the sparse-tooth portion 22B and the bottom plate 116 of the installation component 11. In other words, the sparse-tooth portion 22B is connected to the bottom plate 116 of the installation component 11 via the sparse-tooth connecting portion 21B. Specifically, the sparse-tooth portion 22B includes multiple sparse-tooth units 221B and multiple sparse-tooth gaps 222B between pairs of sparse-tooth units 221B, and the multiple sparse-tooth units 221B are arranged on the sparse-tooth connecting portion 21B. In other words, the sparse-tooth units 221B are extended outward from the sparse-tooth connecting portion 21B to fix the hair root of the hair extension.

The dense-tooth component 30B includes multiple dense-tooth connecting portions 31B and a dense-tooth portion 32B. The dense-tooth portion 32B includes multiple dense-tooth units 321B, and the multiple dense-tooth connecting portions 31B and the multiple dense-tooth units 321B correspond to and are connected to each other. In this embodiment, the dense-tooth unit 321B is pivotally connected between each pair of sparse-tooth units 221B through the dense-tooth connecting portion 31B. In other words, the multiple dense-tooth units 321B are uniformly distributed in the sparse-tooth gap 222B. Preferably, three dense-tooth units 321B are disposed in each sparse-tooth gap 222B. The dense-tooth portion 32B includes multiple dense-tooth units 321B and multiple dense-tooth gaps 322B between pairs of dense-tooth units 321B, and the multiple dense-tooth units 321B are arranged on the dense-tooth connecting portion 31B. In other words, the dense-tooth units 321B are extended outward from the dense-tooth connecting portion 31B to fix the hair root of the hair extension. The dense-tooth component 30B further includes multiple above mentioned connecting members 33, and the connecting members 33 are extended from the dense-tooth connecting portion 31B to connect and fix the installation frame 10.

The dense-tooth component 30B has an operating state and a pivoting state. When the dense-tooth component 30B is in the operating state, the dense-tooth unit 321B is suitable for being parallel to the sparse-tooth unit 221B, and the hair extension is suitable for being hung on the sparse-tooth unit 221B and the dense-tooth unit 321B; and when the dense-tooth component 30B is in the pivoting state, the dense-tooth unit 321B pivots from the installation frame 10 through the dense-tooth connecting portion 31B and is perpendicular to the sparse-tooth unit 221B. When the dense-tooth component 30B is in the operating state, the hair extension care apparatus 1B is suitable for hanging a hair extension with a small transverse length; and when the dense-tooth component 30B is in the pivoting state, the hair extension care apparatus 1B is suitable for hanging a hair extension with a great transverse length.

In this embodiment, the installation component 11 further has multiple inner plate through holes 117, and the inner plate through holes 117 are arranged at the bottom of the inner plate 111. Specifically, the inner plate through holes 117 are extended upward from a joint of the bottom plate 116 and the inner plate 111, and each inner plate through hole 117 corresponds to one sparse-tooth unit 221B and multiple dense-tooth units 321B. The dense-tooth portion 32B is rotatably connected inside the bottom plate 116 through the dense-tooth connecting portion 31B and the connecting member 33, and the connecting member 33 is inserted into the inner plate through hole 117.

FIG. 14 is a first schematic diagram indicating that a hair extension is hung on a hair extension care apparatus 1B according to Embodiment 3 of this utility model. As shown in the figure, the dense-tooth component 30B is in the operating state, the dense-tooth unit 321B is suitable for being parallel to the sparse-tooth unit 221B, and the hair extension is suitable for being hung on the sparse-tooth unit 221B and the dense-tooth unit 321B. Because the dense-tooth component 30B is disposed in the sparse-tooth gap 222B, a transverse interval of the sparse-tooth gap 222B is reduced. Based on this, when the dense-tooth component 30B is in the operating state, the hair extension care apparatus 1B is suitable for hanging a hair extension with a smaller transverse length, which expands an application scope of the hair extension care apparatus 1B and facilitates compatibility with multiple types of hair extensions.

FIG. 15 is a second schematic diagram indicating that a hair extension is hung on a hair extension care apparatus 1B according to Embodiment 3 of this utility model. As shown in the figure, the dense-tooth component 30B is in the pivoting state, the dense-tooth unit 321B pivots from the installation frame 10 through the dense-tooth connecting portion 31B and is perpendicular to the sparse-tooth unit 221B, and the hair extension is suitable for being hung on the sparse-tooth unit 221B. Based on this, when the dense-tooth component 30B is in the pivoting state, the hair extension care apparatus 1B is suitable for hanging a hair extension with a greater transverse length, which expands an application scope of the hair extension care apparatus 1B and facilitates compatibility with multiple types of hair extensions.

In summary, the hair extension care apparatus 1B is provided with the sparse-tooth component 20B and the dense-tooth component 30B, which expands the application scope of the hair extension care apparatus. Such design facilitates compatibility with multiple types of hair extensions, so that hanging, combing, and drying of different types of hair extensions can be completed without changing of tools, thereby simplifying an operation process and improving care efficiency.

Figure 16:
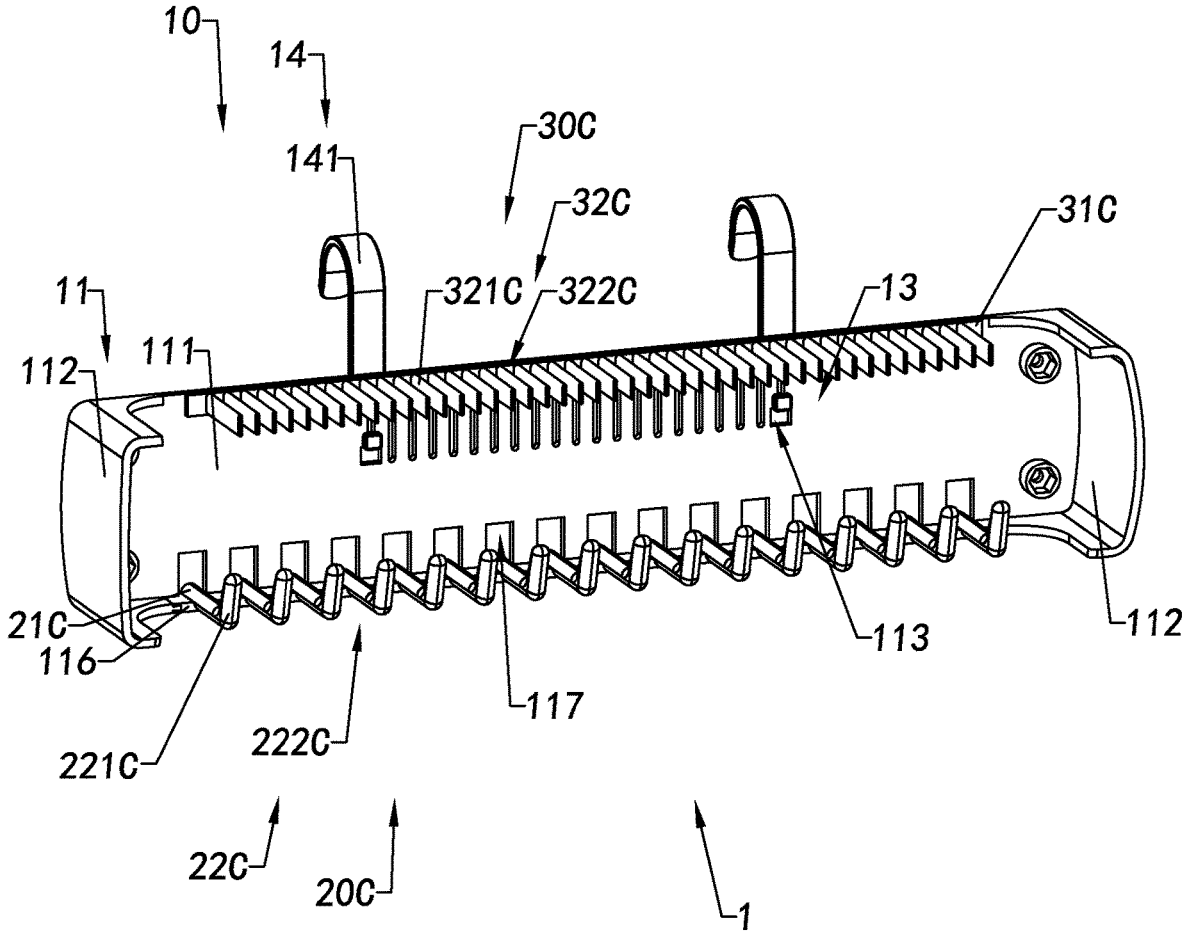
FIG. 16 is a schematic diagram of an overall structure of a hair extension care apparatus according to Embodiment 4 of this utility model.
Figure 17:
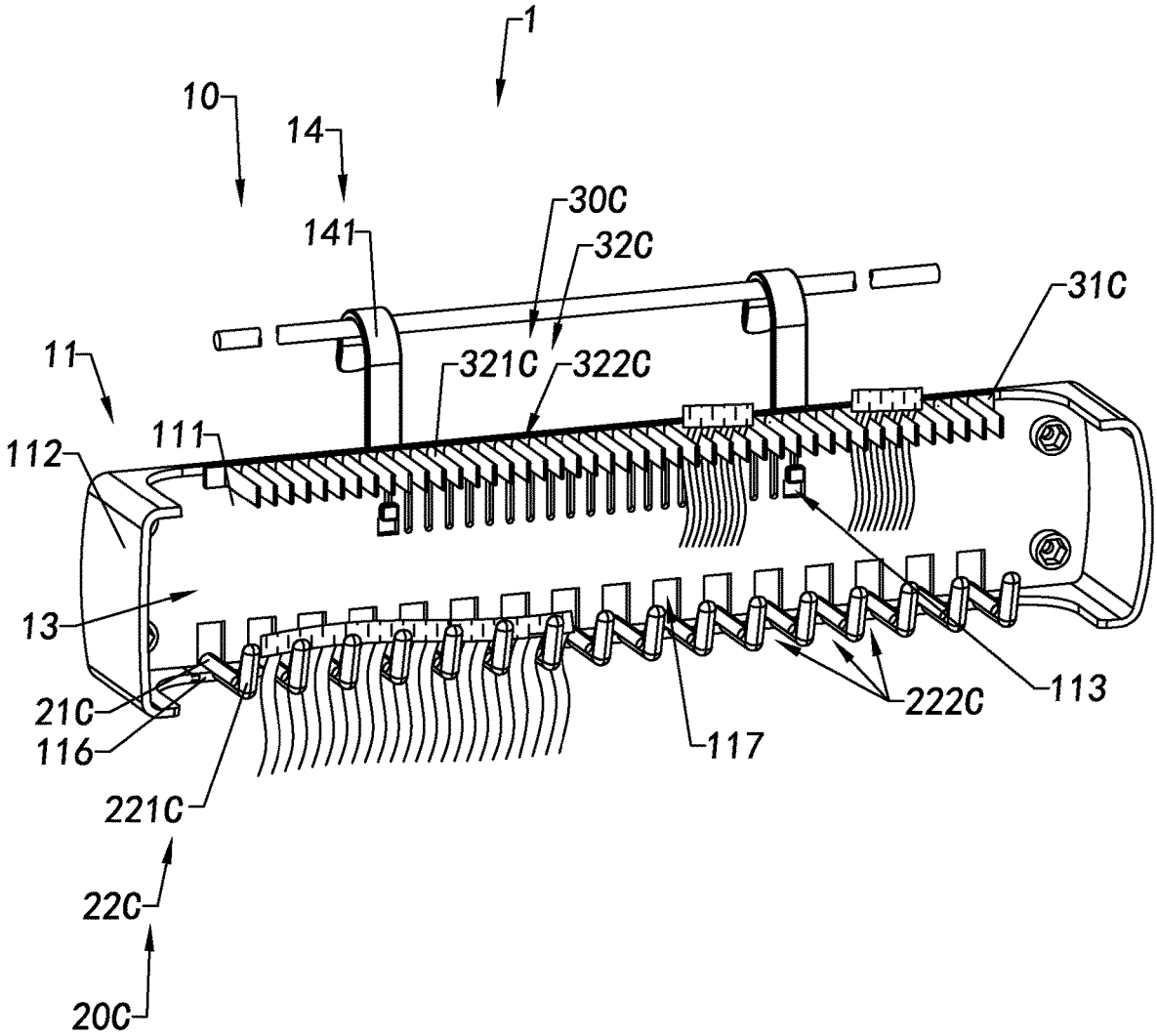
FIG. 17 is a schematic diagram indicating that a hair extension is hung on a hair extension care apparatus according to Embodiment 4 of this utility model.

FIG. 16 and FIG. 17 illustrate a hair extension care apparatus 1 according to preferred Embodiment 4 of this utility model. In this preferred embodiment, the hair extension care apparatus 1C is a modified implementation of the foregoing preferred Embodiment 1. Compared with the foregoing preferred Embodiment 1, in this embodiment, relative positions of the sparse-tooth component 20C and the dense-tooth component 30C have been changed.

Likewise, in this embodiment, the hair extension care apparatus 1C includes an installation frame 10, a sparse-tooth component 20C, and a dense-tooth component 30C, where both the sparse-tooth component 20C and the dense-tooth component 30C are installed on the installation frame 10 to fix a hair extension. Preferably, both the sparse-tooth component 20C and the dense-tooth component 30C are detachably installed on the installation frame 10.

Specifically, in this embodiment, the sparse-tooth component 20C is detachably connected to a lower end of the installation frame 10, and the dense-tooth component 30C is detachably connected to an upper end of the installation frame 10. Specifically, both the sparse-tooth component 20C and the dense-tooth component 30C are perpendicularly connected to the installation frame 10. In summary, the hair extension care apparatus 1C is provided with the sparse-tooth component 20C and the dense-tooth component 30C, which expands the application scope of the hair extension care apparatus. Such design facilitates compatibility with multiple types of hair extensions, so that hanging, combing, and drying of different types of hair extensions can be completed without changing of tools, thereby simplifying an operation process and improving care efficiency.

The installation frame 10 includes an installation component 11 and has installation space 13. In this embodiment, preferably, both the sparse-tooth component 20C and the dense-tooth component 30C are fixed on the installation component 11 and located in the installation space 13. The sparse-tooth component 20C and the dense-tooth component 30C are exposed from the installation space 13 to hang the hair extension. In particular, in this embodiment, the dense-tooth component 30C is detachably connected to an upper end of the installation frame 10 to replace the cover component.

Likewise, the installation component 11 has an inner plate 111, a side plate 112 disposed around the inner plate 111, and a bottom plate 116 connected to a lower portion of the inner plate 111. In this embodiment, the sparse-tooth component 20 is fixed on the bottom plate 116.

The sparse-tooth component 20C includes a sparse-tooth connecting portion 21C and a sparse-tooth portion 22C, the sparse-tooth portion 22C is connected to the sparse-tooth connecting portion 21C, and two ends of the sparse-tooth connecting portion 21C are respectively connected to the sparse-tooth portion 22C and the bottom plate 116 of the installation component 11. In other words, the sparse-tooth portion 22C is connected to the bottom plate 116 of the installation component 11 via the sparse-tooth connecting portion 21C. Specifically, the sparse-tooth portion 22C includes multiple sparse-tooth units 221C and multiple sparse-tooth gaps 222C between pairs of sparse-tooth units 221C, and the multiple sparse-tooth units 221C are arranged on the sparse-tooth connecting portion 21C. In other words, the sparse-tooth units 221C are extended outward from the sparse-tooth connecting portion 21C to fix the hair root of the hair extension.

The dense-tooth component 30C includes multiple dense-tooth connecting portions 31C and a dense-tooth portion 32C, the dense-tooth portion 32C includes multiple dense-tooth units 321C and multiple dense-tooth gaps 322C between pairs of dense-tooth units 321C, and the multiple dense-tooth units 321C are arranged on the dense-tooth connecting portion 31C. In other words, the dense-tooth units 321C are extended outward from the dense-tooth connecting portion 31C to fix the hair root of the hair extension. The dense-tooth component 30C further includes multiple above mentioned connecting members 33, and the connecting members 33 are extended from the dense-tooth connecting portion 31C to connect and fix the installation component 11.

Those skilled in the art should understand that the embodiments of this utility model described above and shown in the accompanying drawings are merely used as examples and are not intended to limit this utility model. The purpose of this utility model has been completely and effectively achieved. The functions and structural principles of this utility model have been demonstrated and explained in the embodiments. Any variation or modification can be made to the embodiments of this utility model without departing from the principles.

What is claimed is:

1. A hair extension care apparatus, comprising:

an installation frame;

a sparse-tooth component; and a dense-tooth component, wherein both the sparse-tooth component and the dense-tooth component are installed on the installation frame to fix a hair extension;

wherein the dense-tooth component comprises a dense-tooth connecting portion and a dense-tooth portion, the dense-tooth portion is connected to the dense-tooth connecting portion, and the dense-tooth portion is detachably connected to the installation frame through the dense-tooth connecting portion;

wherein the dense-tooth portion comprises multiple dense-tooth units and multiple dense-tooth gaps located between pairs of the dense-tooth units, and the multiple dense-tooth units are arranged at the dense-tooth connecting portion;

wherein the sparse-tooth component comprises a sparse-tooth connecting portion and a sparse-tooth portion, the sparse-tooth portion is connected to the sparse-tooth connecting portion, and the sparse-tooth portion is connected to the installation frame through the sparse-tooth connecting portion;

wherein the sparse-tooth portion comprises multiple sparse-tooth units and multiple sparse-tooth gaps located between pairs of the sparse-tooth units, and the multiple sparse-tooth units are arranged on the installation frame;

wherein a transverse length of the sparse-tooth gap is greater than a transverse length of the dense-tooth gap.

2. The hair extension care apparatus according to claim 1, wherein each sparse-tooth unit comprises an extension portion and a bent portion, and the bent portion is integrally bent and extended outward from the extension portion.

3. The hair extension care apparatus according to claim 1, wherein the installation frame comprises an installation component and a cover component, and has installation space, a side of the cover component is rotatably connected to the installation component, to form the installation space between the installation component and the cover component, and both the sparse-tooth component and the dense-tooth component are fixed on the installation component and located in the installation space.

4. The hair extension care apparatus according to claim 3, wherein the installation component has a bottom plate connected to a lower portion of the inner plate, the sparse-tooth component is fixed on the bottom plate.

5. The hair extension care apparatus according to claim 4, wherein the installation component has an inner plate, a side plate disposed around the inner plate, and the dense-tooth component is detachably installed on the inner plate.

6. The hair extension care apparatus according to claim 4, wherein both the dense-tooth component and the sparse-tooth component are installed on the installation component, and the dense-tooth component is installed above the sparse-tooth component.

7. The hair extension care apparatus according to claim 4, wherein the sparse-tooth component and the dense-tooth component are disposed side by side on the installation frame, and the dense-tooth component and the sparse-tooth component are disposed on a same horizontal line.

8. The hair extension care apparatus according to claim 4, wherein the dense-tooth unit is pivotally connected between each pair of sparse-tooth units through the dense-tooth connecting portion.

9. The hair extension care apparatus according to claim 3, wherein the dense-tooth component further comprises multiple connecting members, and the connecting members are extended from the dense-tooth connecting portion to connect and fix the installation component.

10. The hair extension care apparatus according to claim 9, wherein the installation component has multiple connecting member clamping holes for installing the connecting members, each connecting member clamping hole has a bigger hole and a smaller hole, the bigger hole and the smaller hole communicate with each other, and the connecting member is suitable for entering through the bigger hole and sliding into the smaller hole to complete clamping and fixing.

11. The hair extension care apparatus according to claim 3, wherein the installation frame further comprises a fixing component, the fixing component comprises at least one suspension arm and multiple attraction components, and all the suspension arm and attraction components are detachably installed on the installation component.

12. The hair extension care apparatus according to claim 11, wherein the suspension arm is installed on the installation component, and each of the at least one suspension arm has one end detachably connected to the installation component and has another end bent and extended to fix the installation component and the cover component on a rod body.

13. The hair extension care apparatus according to claim 11, wherein the at least one suspension arm comprises two suspension arms, wherein the installation component further has two installation holes, the two installation holes are respectively extended outward from a surface of the inner plate to penetrate through the inner plate, and ends of the two suspension arms are suitable for being inserted into the two installation holes respectively.

14. The hair extension care apparatus according to claim 11, wherein each attraction component comprises an attraction unit, a connecting rod, and a fixing unit, the attraction unit is connected to a front end of the connecting rod, and the fixing unit is suitable for being installed on the connecting rod to fix the connecting rod on the installation component.

15. The hair extension care apparatus according to claim 14, wherein the installation component further has multiple attraction holes corresponding to the attraction components, the attraction holes are extended outward from the inner plate of the installation component to penetrate through the inner plate, and the connecting rod is suitable for passing through the attraction hole and being fixed by the fixing unit.

* * * * *